US011329408B2

(12) United States Patent
Watanabe et al.

(10) Patent No.: US 11,329,408 B2
(45) Date of Patent: May 10, 2022

(54) CONDUCTOR CONNECTING STRUCTURE WITH A SCREW MEMBER RETAINING PORTION

(71) Applicant: Yazaki Corporation, Tokyo (JP)

(72) Inventors: Kazuma Watanabe, Shizuoka (JP); Yasuhiro Yamaguchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/133,646

(22) Filed: Dec. 24, 2020

(65) Prior Publication Data

US 2021/0210876 A1 Jul. 8, 2021

(30) Foreign Application Priority Data

Jan. 8, 2020 (JP) ..... JP2020-001241

(51) Int. Cl.

| | |
|---|---|
| ***H01R 9/18*** | (2006.01) |
| ***H01R 4/34*** | (2006.01) |
| ***H01R 9/24*** | (2006.01) |
| *H01R 9/11* | (2006.01) |

(52) U.S. Cl.

CPC ..... *H01R 9/18* (2013.01); *H01R 4/34* (2013.01); *H01R 9/2416* (2013.01); *H01R 9/11* (2013.01)

(58) Field of Classification Search

CPC . H01R 4/34; H01R 4/30; H01R 4/301; H01R 4/302; H01R 4/305; H01R 9/18; H01R 9/2416

See application file for complete search history.

(56) References Cited

U.S. PATENT DOCUMENTS

| | | | | |
|---|---|---|---|---|
| 6,702,612 | B2 * | 3/2004 | Miyazaki | H01R 13/521 439/559 |
| 9,083,107 | B2 * | 7/2015 | Suzuki | H01R 13/5202 |
| 10,082,171 | B2 * | 9/2018 | Yamauchi | F16B 4/004 |
| 10,153,584 | B2 * | 12/2018 | Iwabe | H01R 13/631 |
| 2004/0214477 | A1 | 10/2004 | Ikeda | |
| 2019/0214745 | A1 | 7/2019 | Uchida et al. | |

FOREIGN PATENT DOCUMENTS

| | | | |
|---|---|---|---|
| JP | 2004-327185 | A | 11/2004 |

* cited by examiner

*Primary Examiner* — Vanessa Girardi
(74) *Attorney, Agent, or Firm* — Kenealy Vaidya LLP

(57) ABSTRACT

A conductor connecting structure includes: first and second conductors having terminal portions; a support having recessed portions; first screw members accommodated in the recessed portions; and second screw members that co-fasten the terminal portions of the first and the second conductors by screwing to the first screw members. The recessed portions have first and second wall surfaces that face each other in an opposing direction, and restricting surfaces along the opposing direction to restrict the rotation of the first screw members. The first and second wall surfaces configure a retaining portion to retain the first screw member before being screwed, and an allowable portion located closer to the inlet of the recessed portion. The distance between the first and the second wall surfaces in the allowable portion is greater than the distance in the retaining portion.

20 Claims, 18 Drawing Sheets

CONDUCTOR CONNECTING STRUCTURE WITH A SCREW MEMBER RETAINING PORTION

CROSS-REFERENCE TO RELATED APPLICATION(S)

The present application claims priority to and incorporates by reference the entire contents of Japanese Patent Application No. 2020-001241 filed in Japan on Jan. 8, 2020.

BACKGROUND OF THE INVENTION

1. Field of the Invention

The present invention relates to a conductor connecting structure.

2. Description of the Related Art

Conventionally, there is a terminal block that absorbs a difference in height between the terminal block and a connecting member. Japanese Patent Application Laid-open No. 2004-327185 discloses a technique for absorbing a difference in height between a first fastening member and a connecting portion of a conductive path by moving the first fastening member in a fastening member housing chamber in a fastening direction, thereby fastening first and second connecting portions to fix them to a terminal block.

It is desirable to be capable of adjusting positions of conductors in a direction that intersects a fastening direction by screw members. For example, it is advantageous in absorbing tolerances if the positions of the conductors can be adjusted in a direction perpendicular to the fastening direction after co-fastening by the screw members is completed.

SUMMARY OF THE INVENTION

An object of the present invention is to provide a conductor connecting structure that enables positional adjustment of the conductors in a direction that intersects the fastening direction by the screw members.

In order to achieve the above mentioned object, a conductor connecting structure according to one aspect of the present invention includes a first conductor having a flat plate terminal portion; a second conductor having a flat plate terminal portion; a support having a recessed portion; a first screw member accommodated in the recessed portion; and a second screw member that co-fastens the terminal portion of the first conductor and the terminal portion of the second conductor by screwing to the first screw member, wherein the recessed portion has a first wall surface and a second wall surface that face each other in an opposing direction, and a restricting surface that connects the first wall surface and the second wall surface along the opposing direction and restricts rotation of the first screw member, the first wall surface and the second wall surface configure a retaining portion, located at a bottom of the recessed portion, configured to retain the first screw member before being screwed to the second screw member, and an allowable portion located closer to an inlet of the recessed portion than the retaining portion, and a distance between the first wall surface and the second wall surface in the allowable portion is greater than a distance between the first wall surface and the second wall surface in the retaining portion.

According to another aspect of the present invention, in the conductor connecting structure, it is preferable that the first screw member is a nut, the second screw member is a bolt, and the bolt is screwed to the nut and rotated relative to the nut to pull the nut out of the retaining portion.

According to still another aspect of the present invention, in the conductor connecting structure, it is preferable that the recessed portion has a third wall surface and a fourth wall surface that face each other and connect the first wall surface and the second wall surface along the opposing direction respectively; and each of the third and the fourth wall surfaces restricts the rotation of the first screw member as the restricting surface.

According to still another aspect of the present invention, in the conductor connecting structure, it is preferable that the support is a housing of a connector, the second conductor is a busbar that has a first terminal portion connected to the first conductor and a second terminal portion to be connected to a mating terminal, and is bent so that the first terminal portion and the second terminal portion are orthogonal to each other, and the opposing direction is a direction orthogonal to a main surface of the second terminal portion.

According to still another aspect of the present invention, in the conductor connecting structure, it is preferable that the housing has a rib configured to guide the first terminal portion along the opposing direction.

According to still another aspect of the present invention, in the conductor connecting structure, it is preferable that the first conductor is a terminal connected to a wire, the support is a housing of a connector, a portion between an outer peripheral surface of the wire and the housing is sealed by a sealing member, and the opposing direction is a direction orthogonal to an axial direction of the wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A conductor connecting structure according to an embodiment of the present invention will be described in detail with reference to the drawings. The present invention is not limited by the accompanying embodiment. The components in the following embodiments include those that can be readily conceived by a person skilled in the art or those that are substantially the same.

EMBODIMENT

Figure 1:
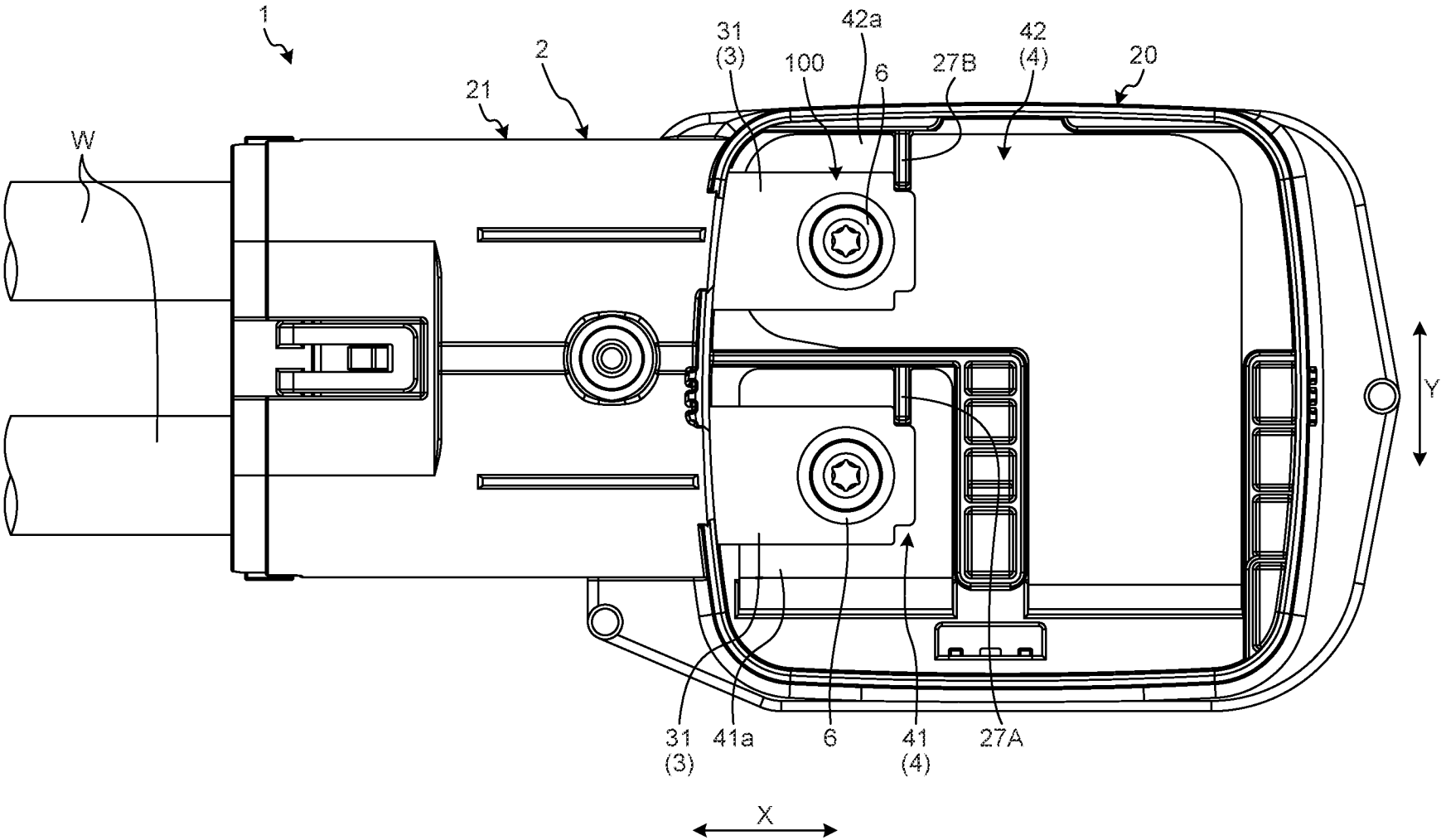
FIG. 1 is a plan view of a connector according to an embodiment.
Figure 2:
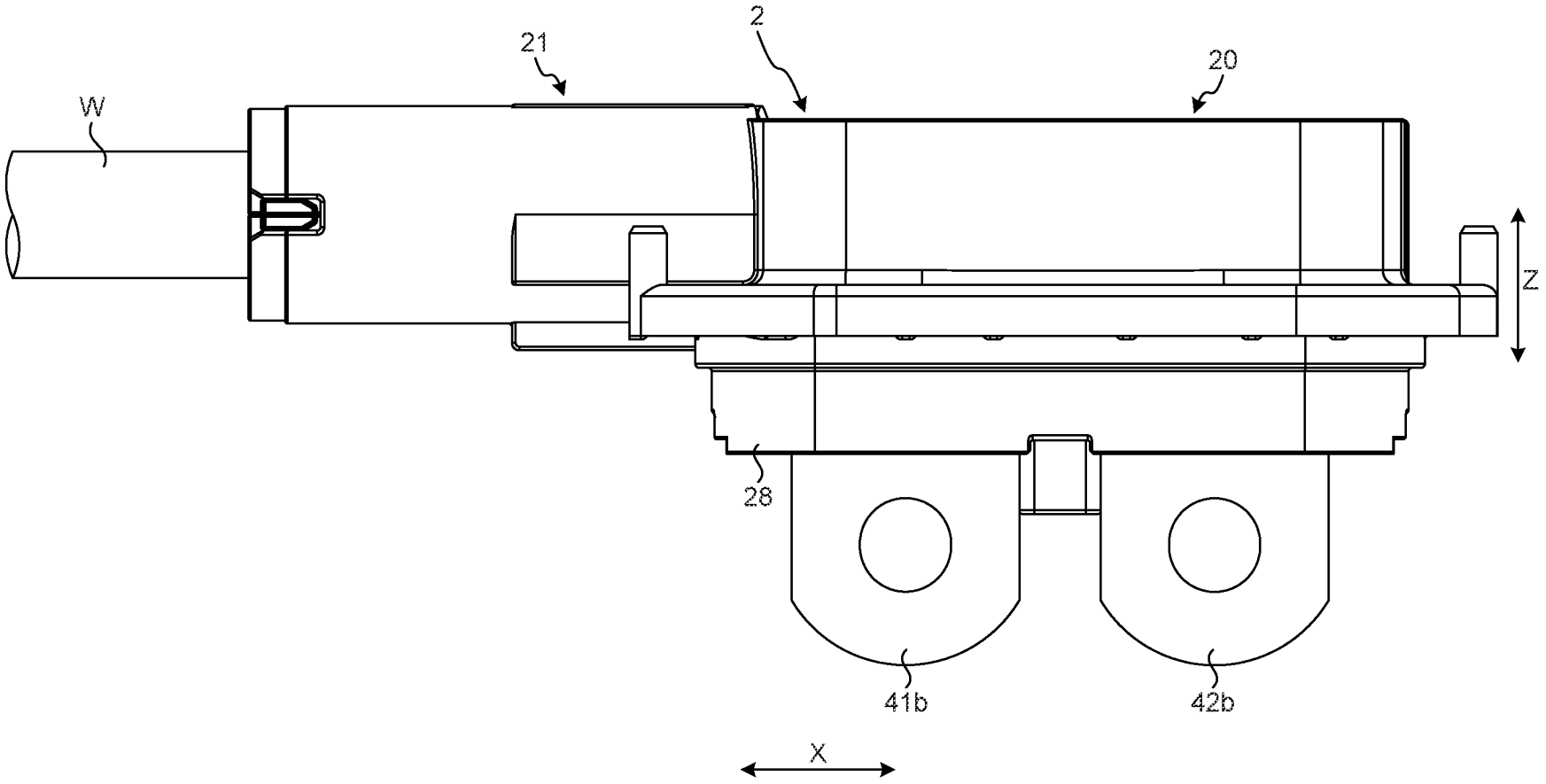
FIG. 2 is a side view of the connector according to the embodiment.
Figure 3:
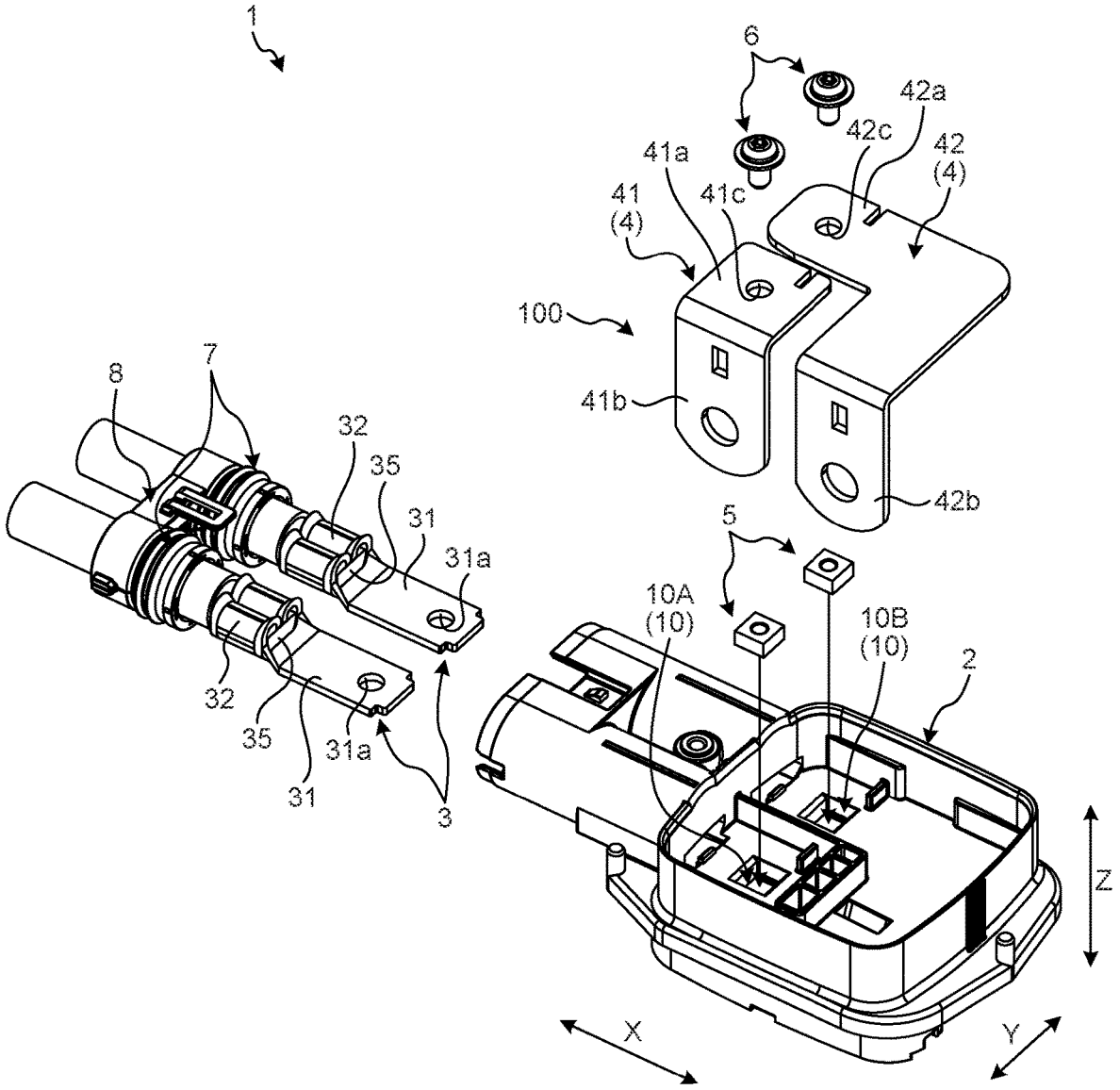
FIG. 3 is an exploded view of a conductor connecting structure and the connector according to the embodiment.
Figure 4:
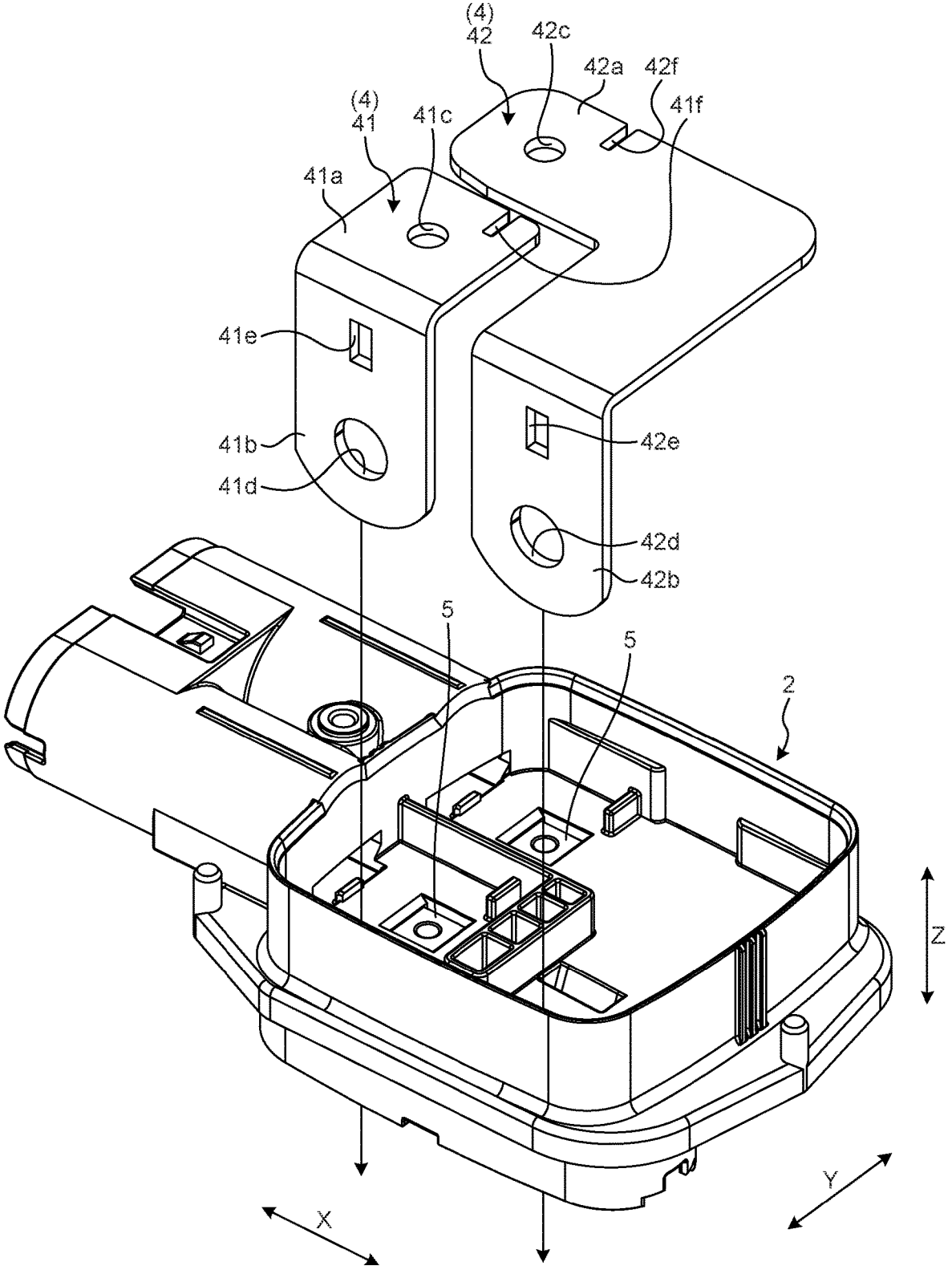
FIG. 4 is a perspective view illustrating the attachment of busbars to a housing.
Figure 5:
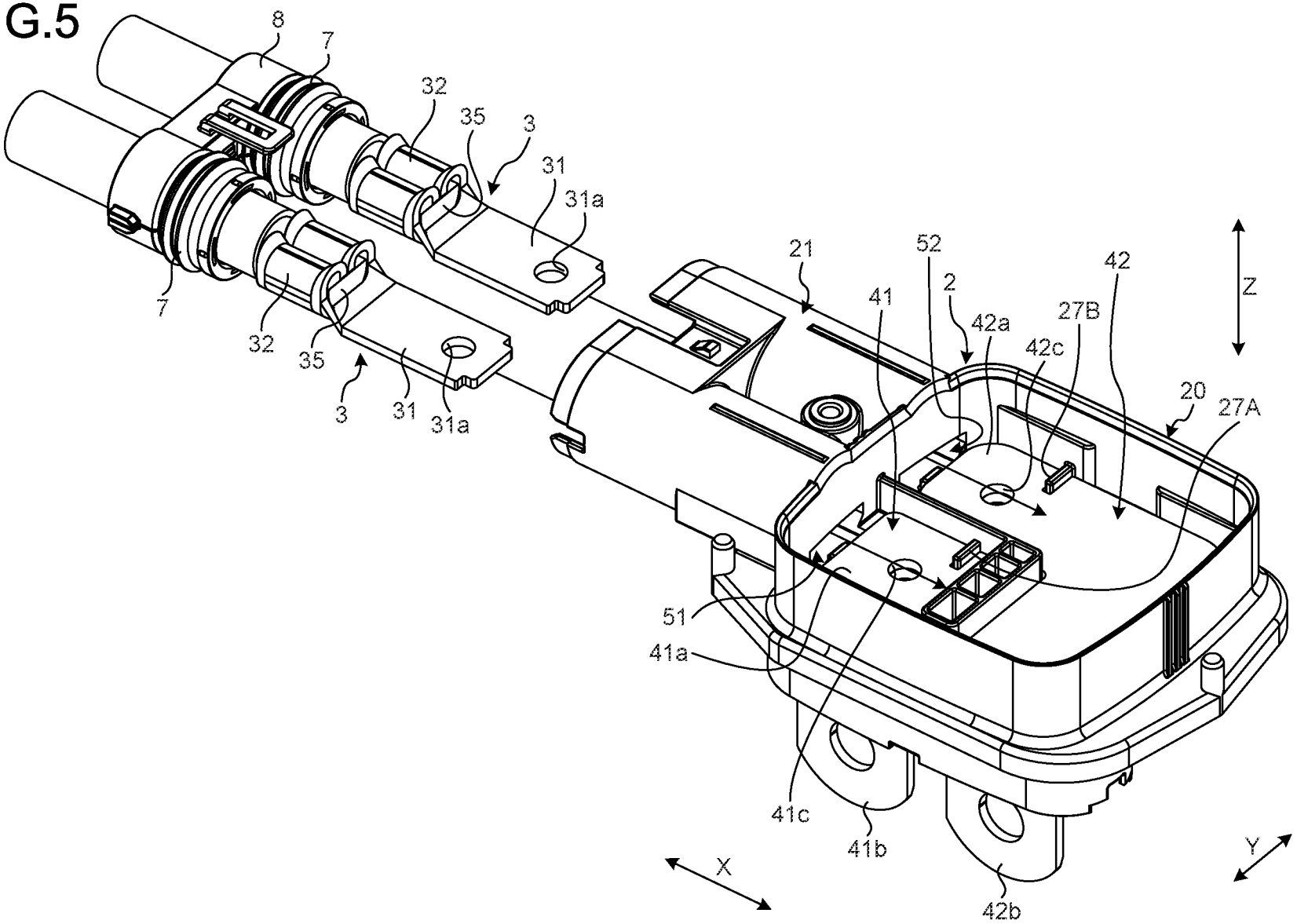
FIG. 5 is a perspective view illustrating crimping terminals and wires inserted into the housing.
Figure 6:
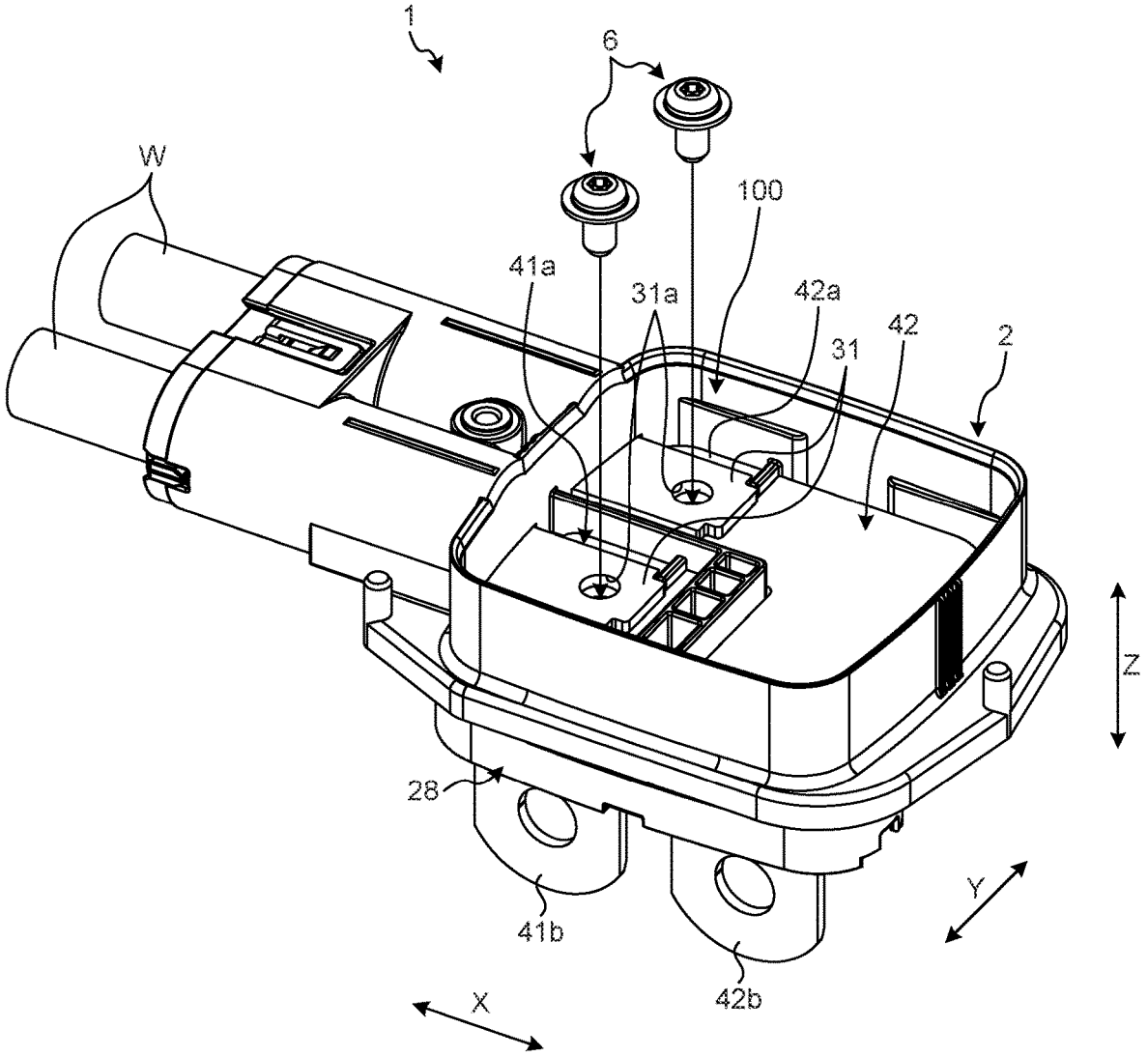
FIG. 6 is a perspective view of the attachment of bolts.
Figure 7:
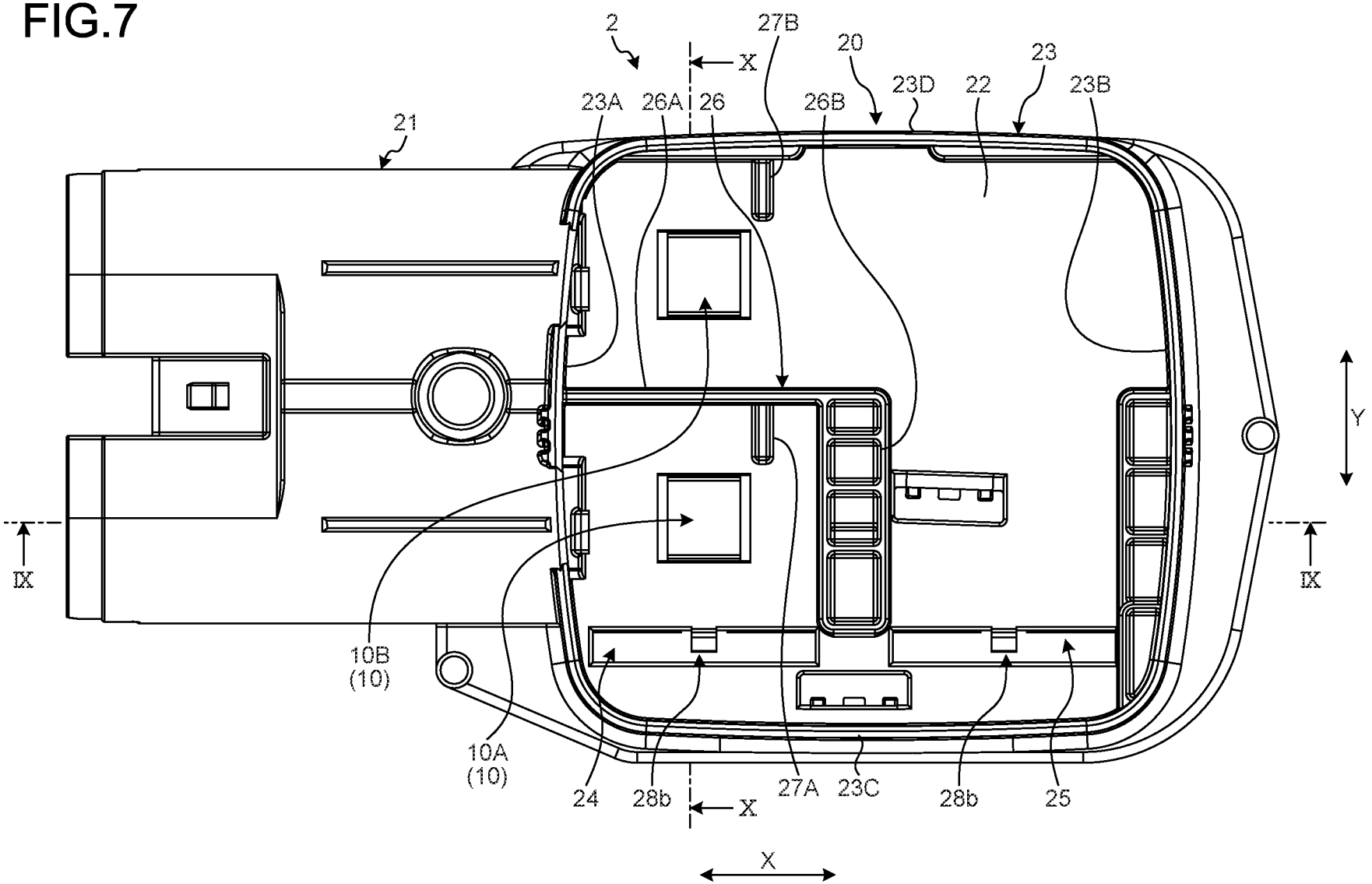
FIG. 7 is a plan view of the housing according to the embodiment.
Figure 8:
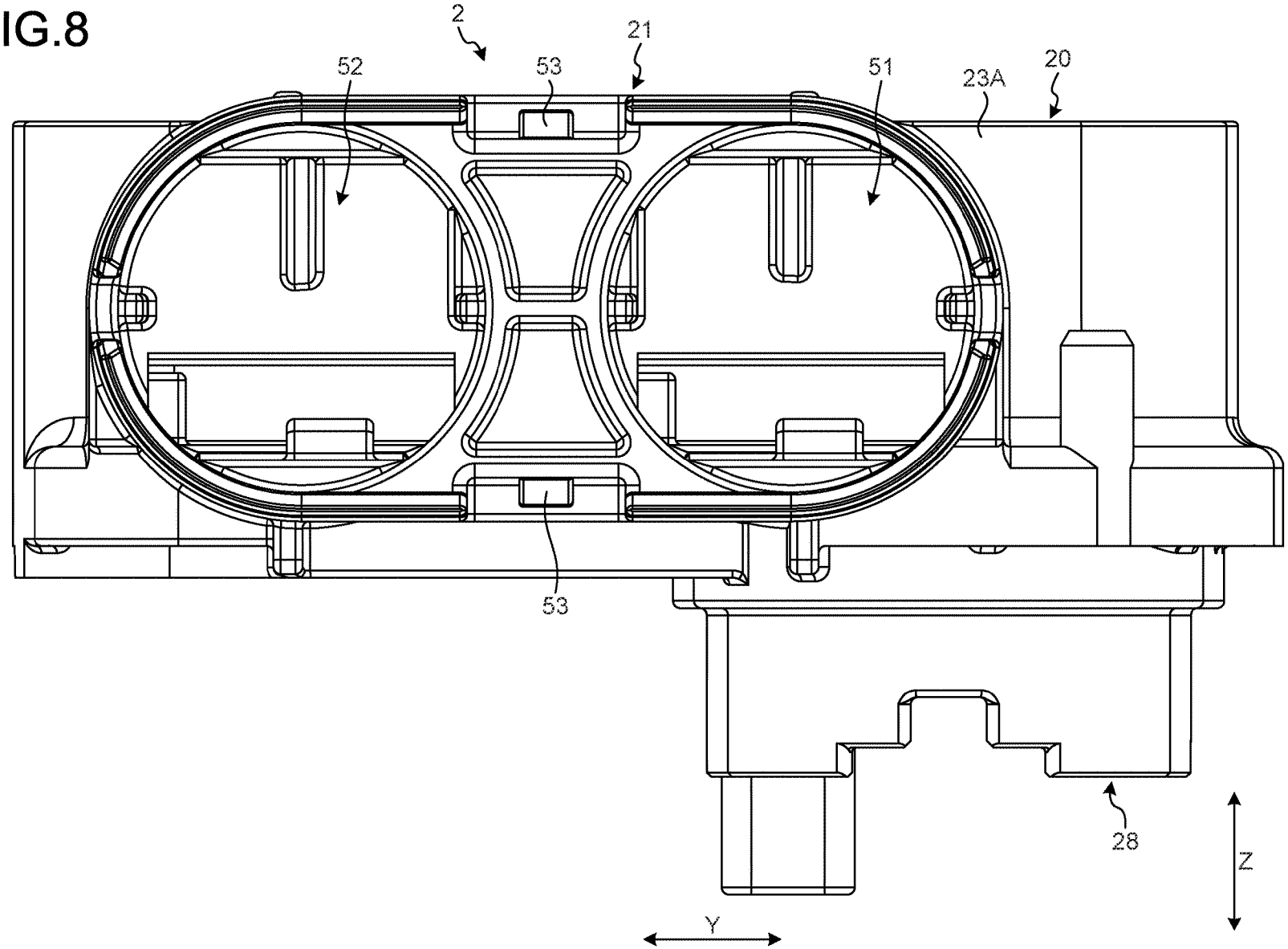
FIG. 8 is a front view of the housing according to the embodiment.
Figure 9:
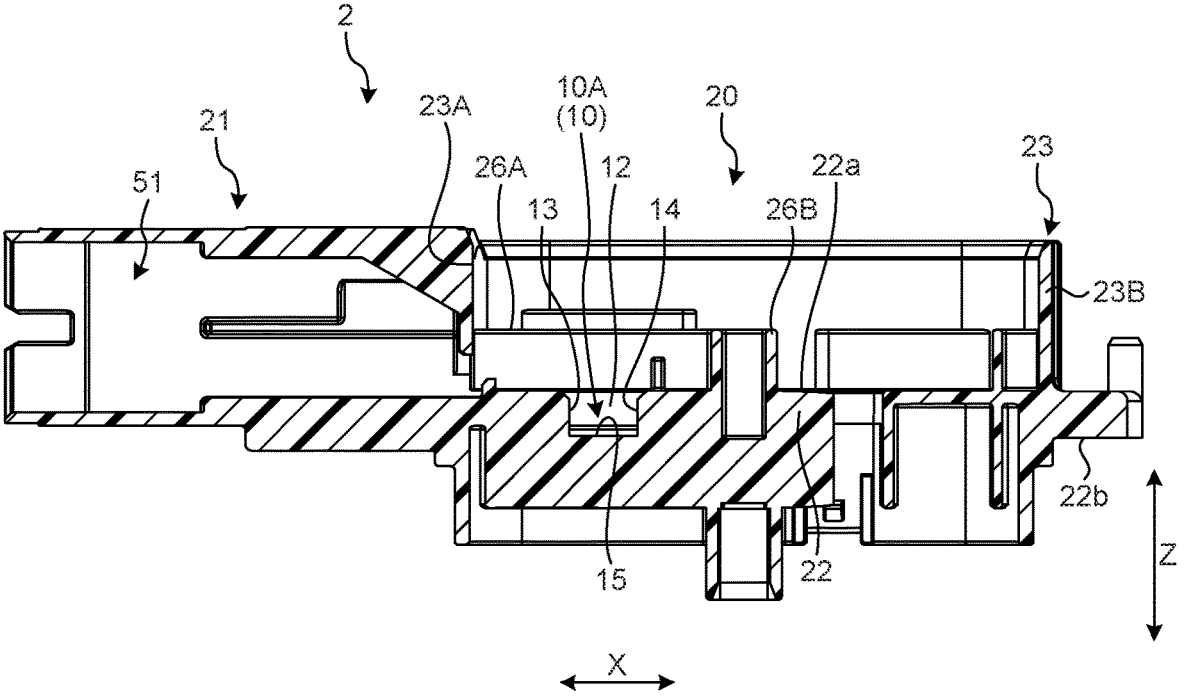
FIG. 9 is a sectional view of the housing according to the embodiment.
Figure 10:
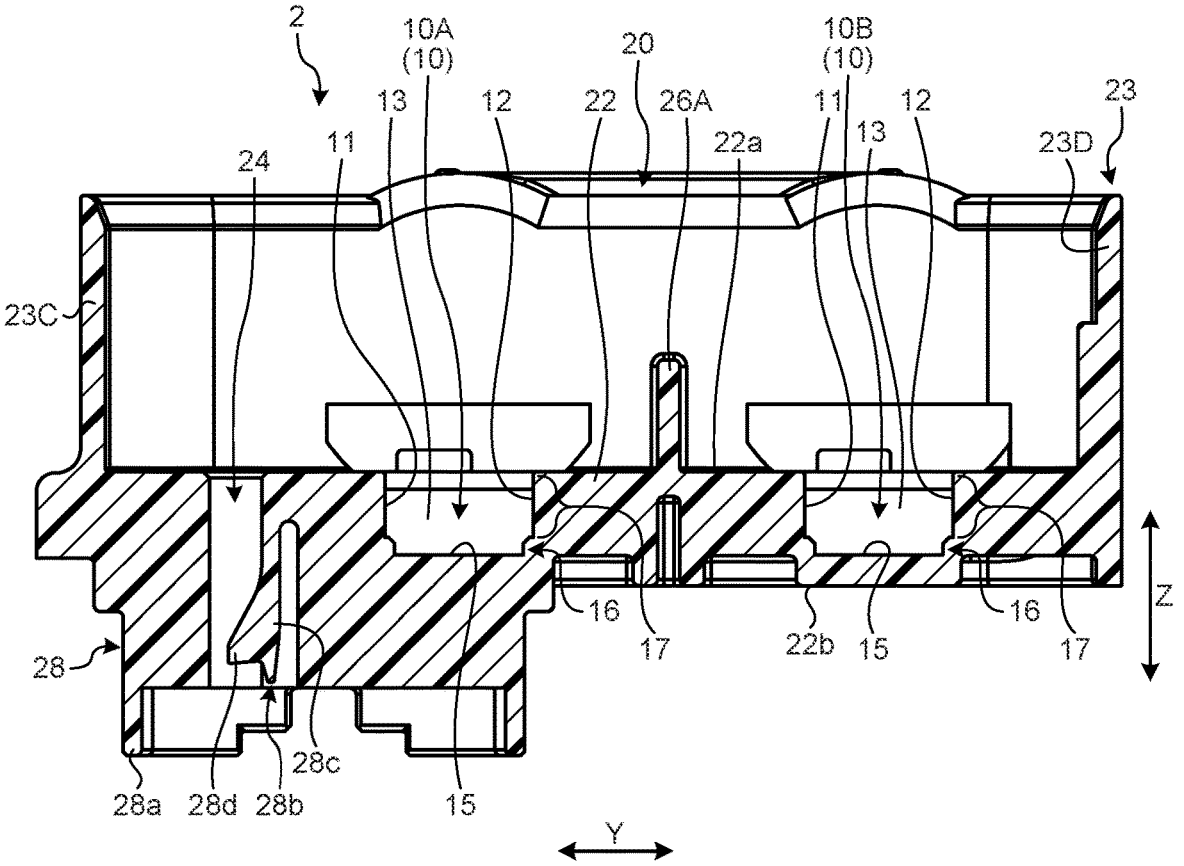
FIG. 10 is a sectional view of the housing according to the embodiment.

Referring to FIGS. 1 to 19, an embodiment will be described. The present embodiment relates to a conductor connecting structure. FIG. 1 is a plan view of a connector according to an embodiment; FIG. 2 is a side view of the connector according to the embodiment; FIG. 3 is an exploded view of a conductor connecting structure and the connector according to the embodiment; FIG. 4 is a perspective view illustrating the attachment of busbars to a housing; FIG. 5 is a perspective view illustrating crimping terminals and wires inserted into the housing; FIG. 6 is a perspective view of the attachment of bolts; FIG. 7 is a plan view of the housing according to the embodiment; FIG. 8 is a front view of the housing according to the embodiment; FIG. 9 is a sectional view of the housing according to the embodiment; and FIG. 10 is a sectional view of the housing according to the embodiment.

Figure 11:
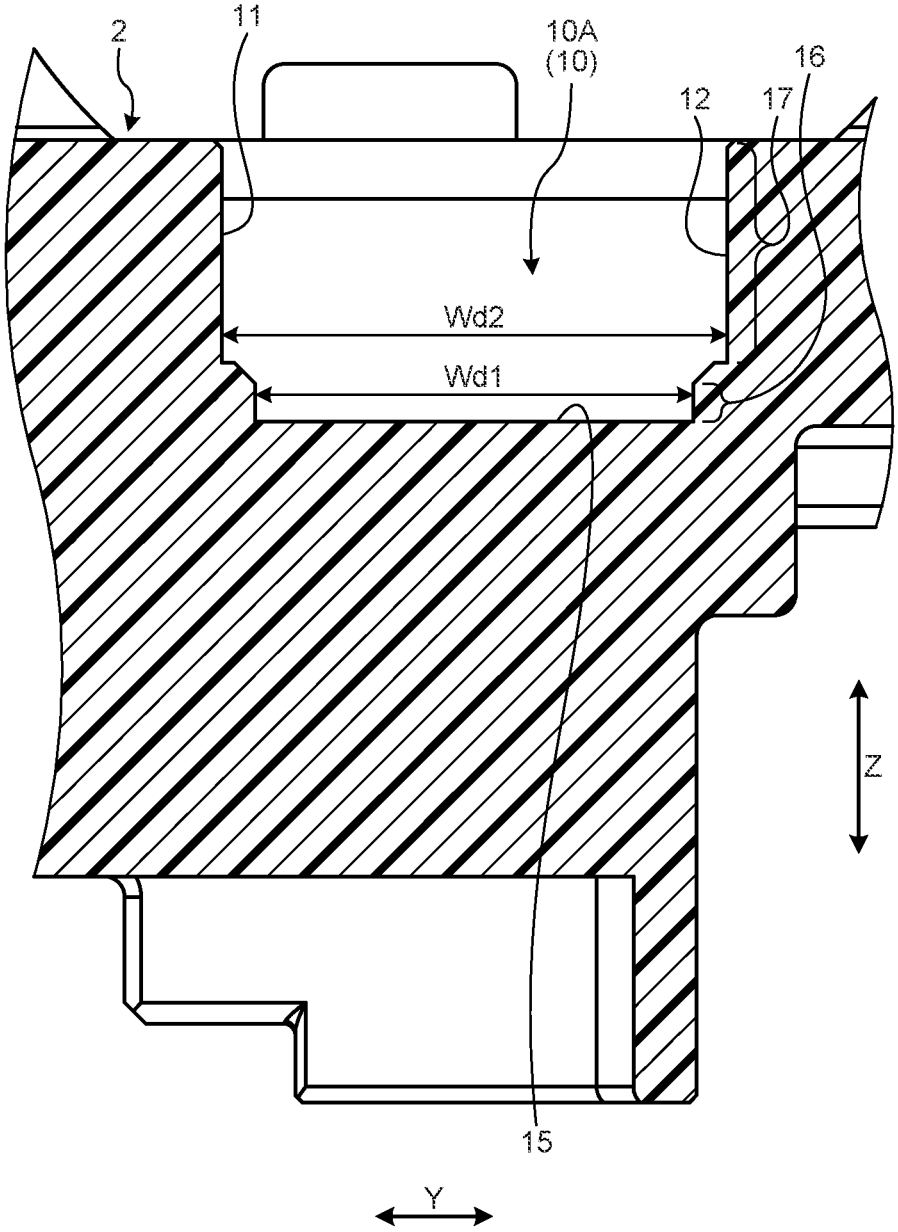
FIG. 11 is a sectional view of a recessed portion according to the embodiment.
Figure 12:
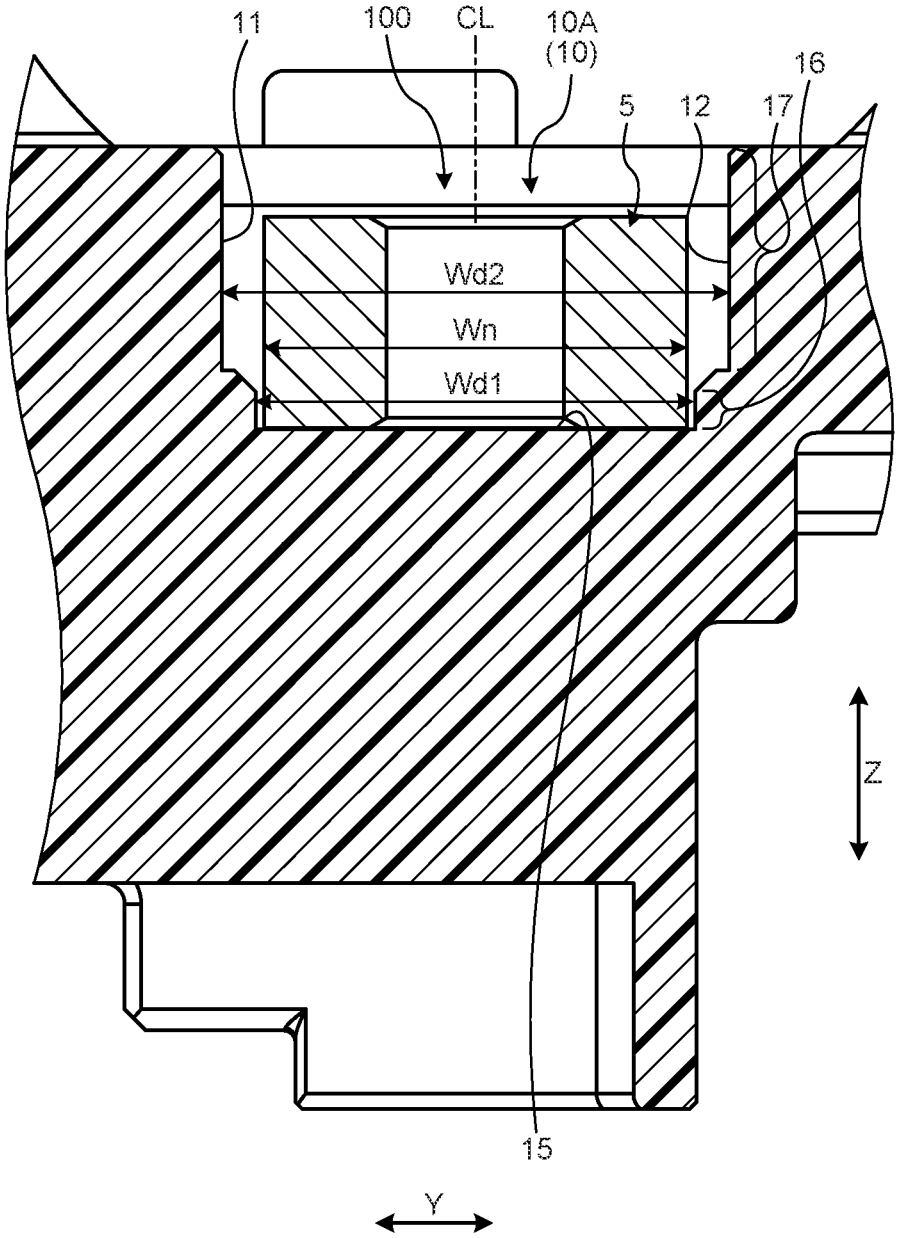
FIG. 12 is a sectional view of a nut accommodated in the recessed portion.
Figure 13:
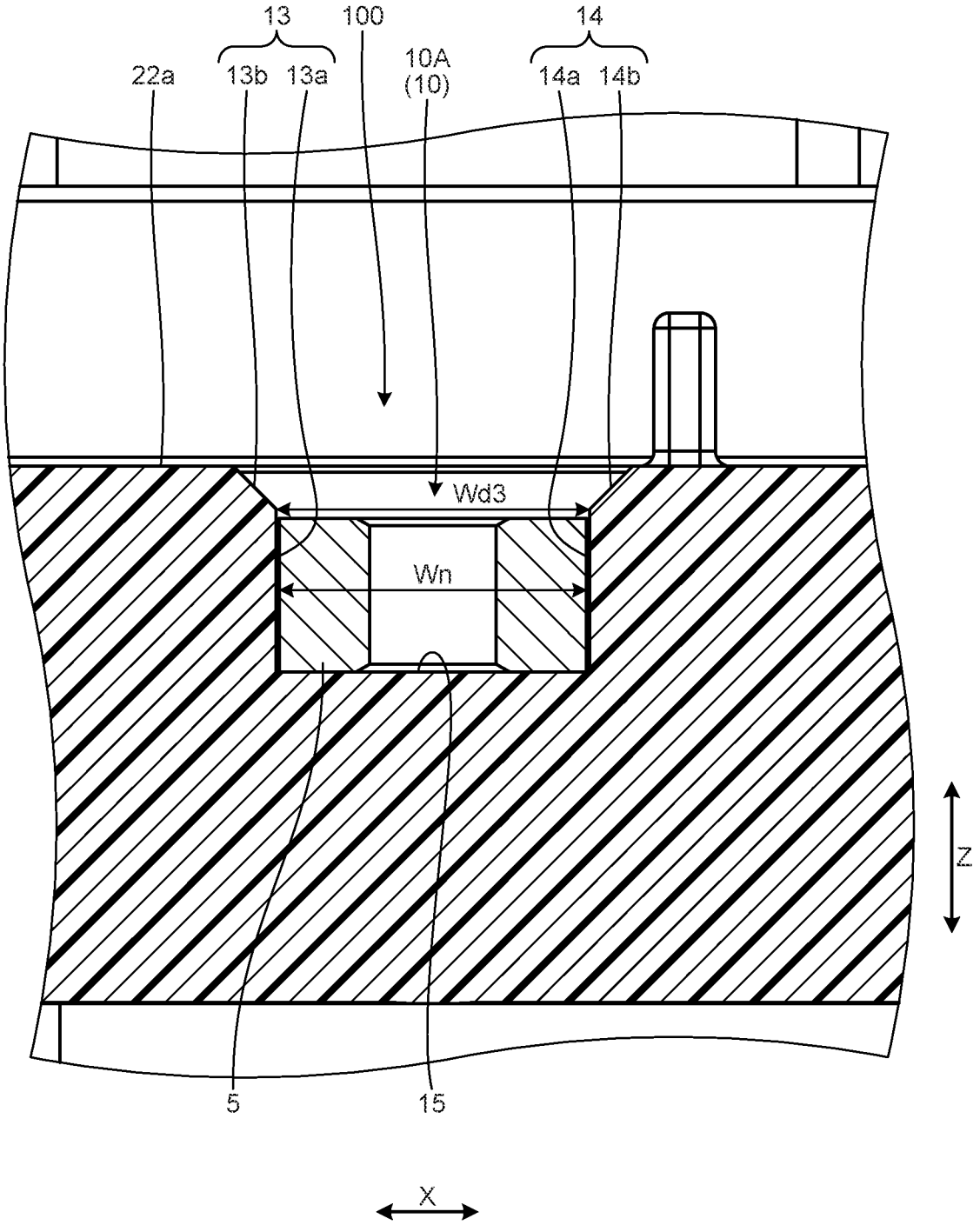
FIG. 13 is a sectional view of the nut accommodated in the recessed portion.
Figure 14:
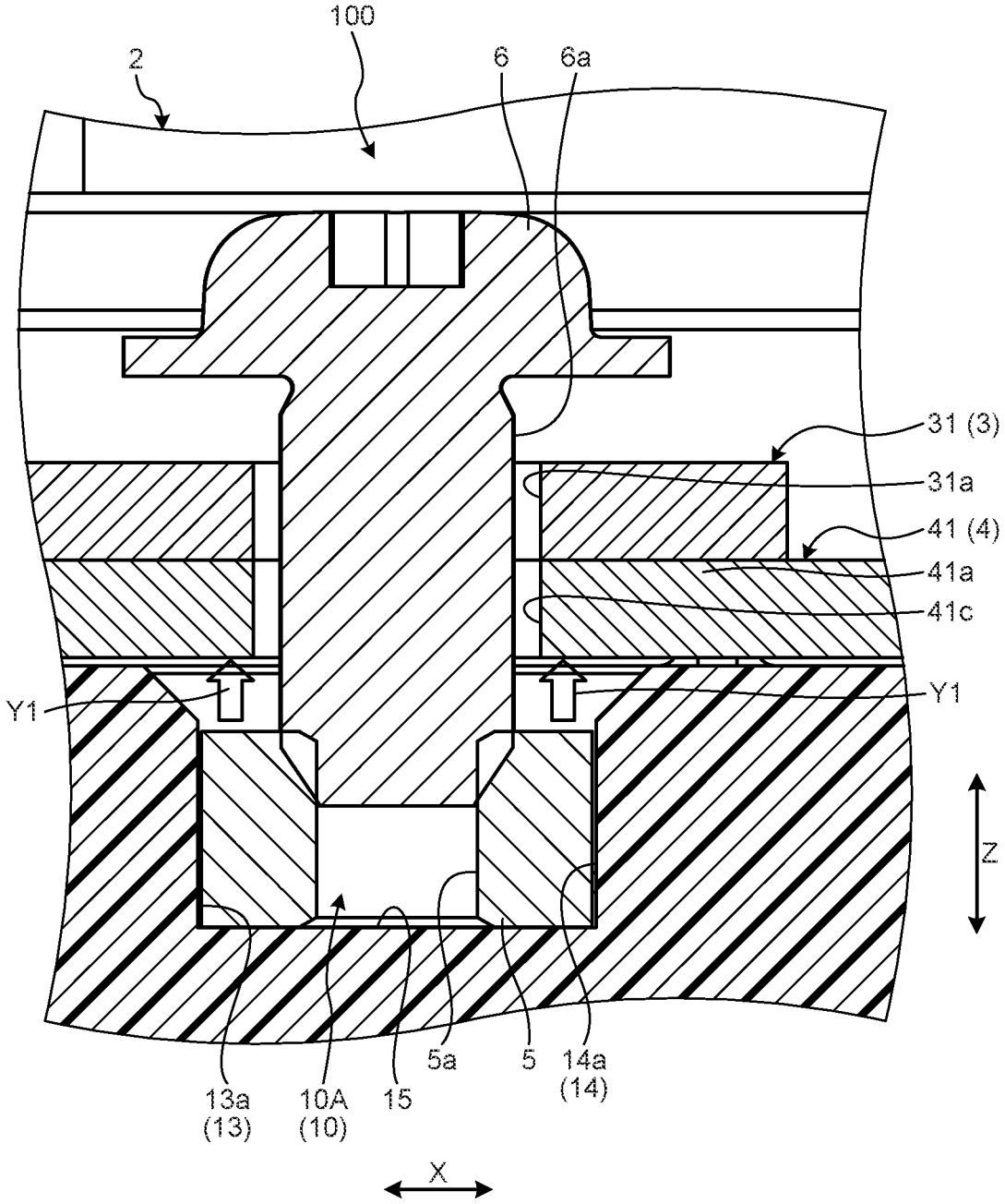
FIG. 14 is a sectional view of the bolt being screwed to the nut.
Figure 15:
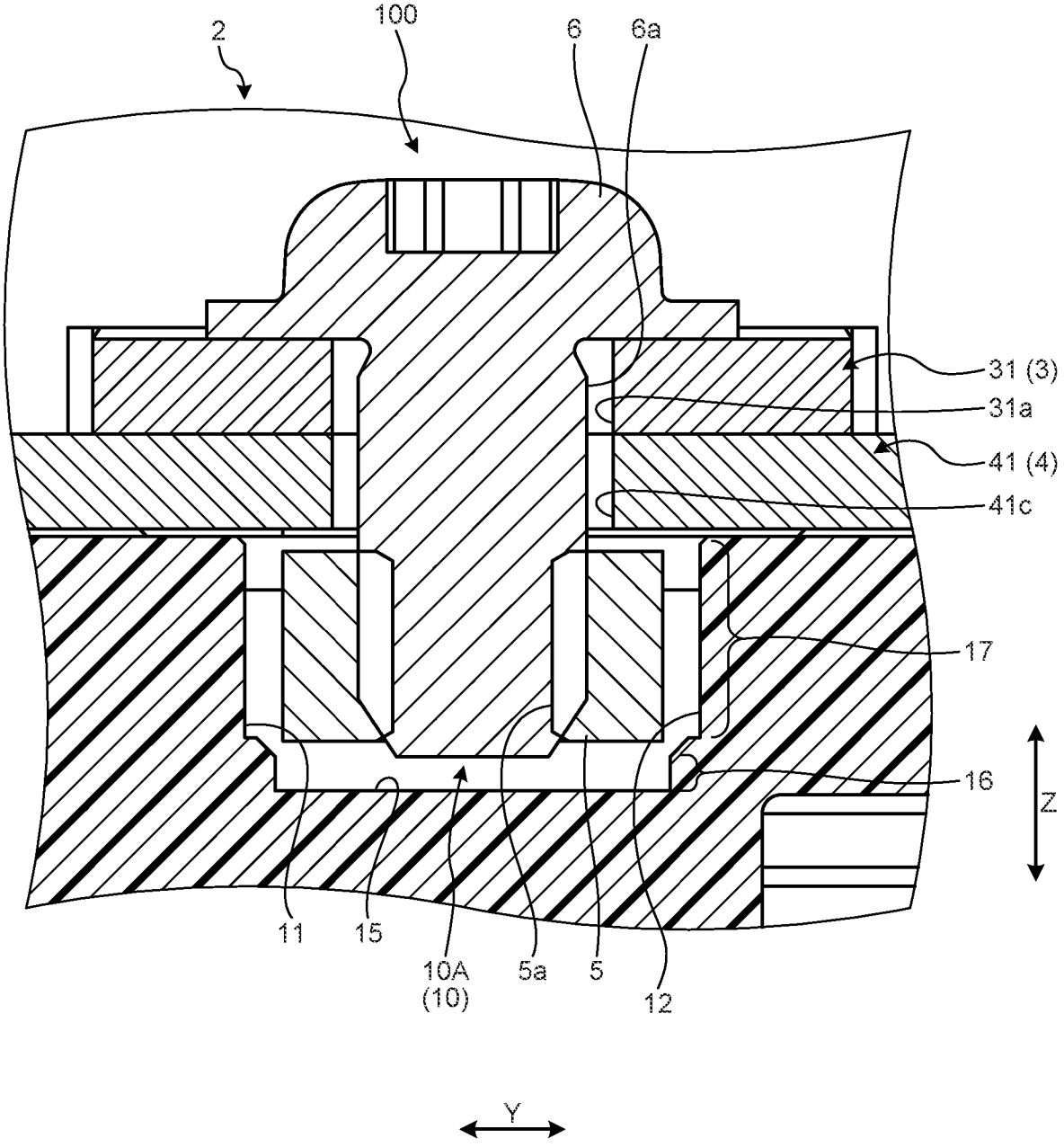
FIG. 15 is a sectional view of a bolt being screwed to the nut.
Figure 16:
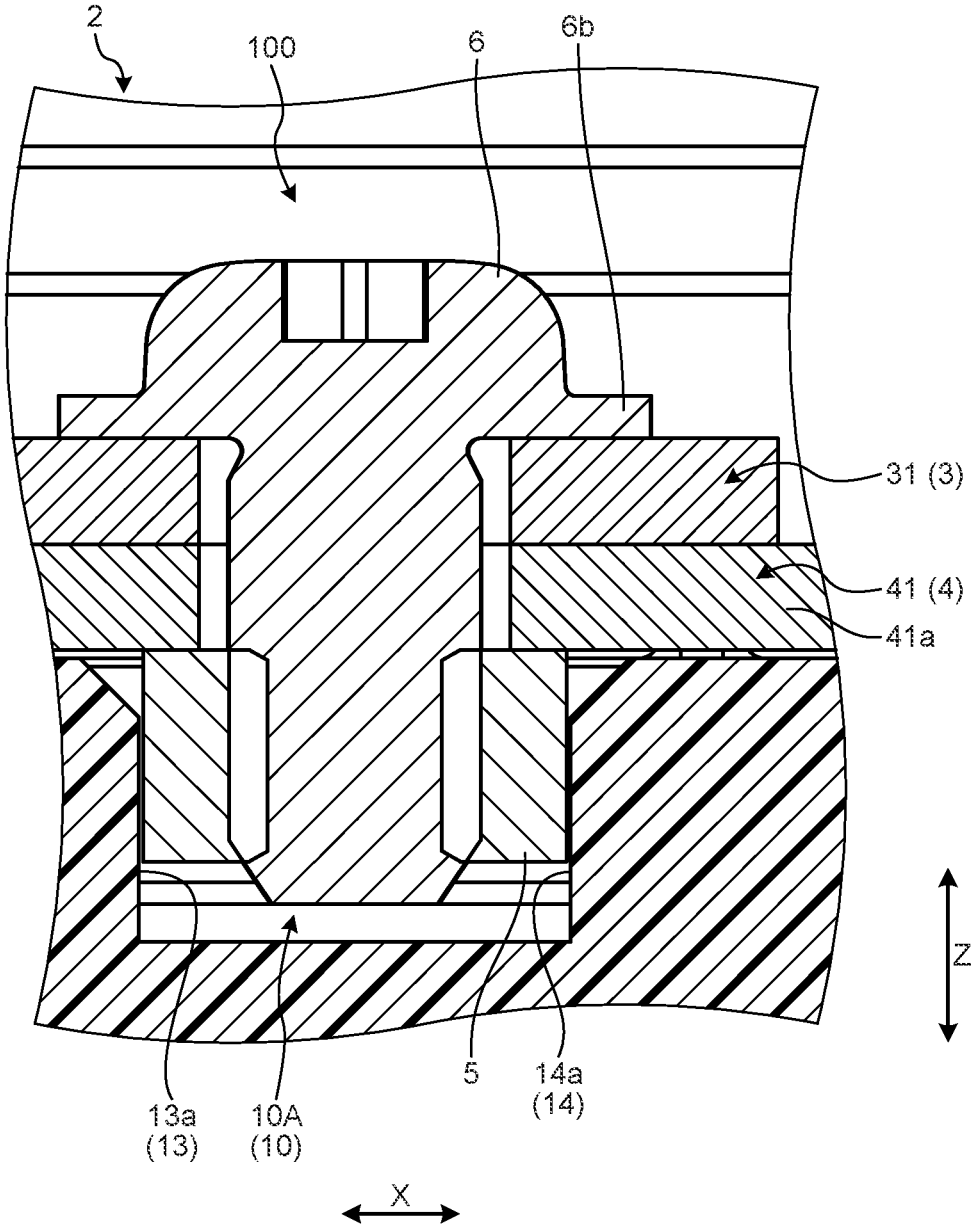
FIG. 16 is a sectional view of a co-fastened first busbar and a terminal portion.
Figure 17:
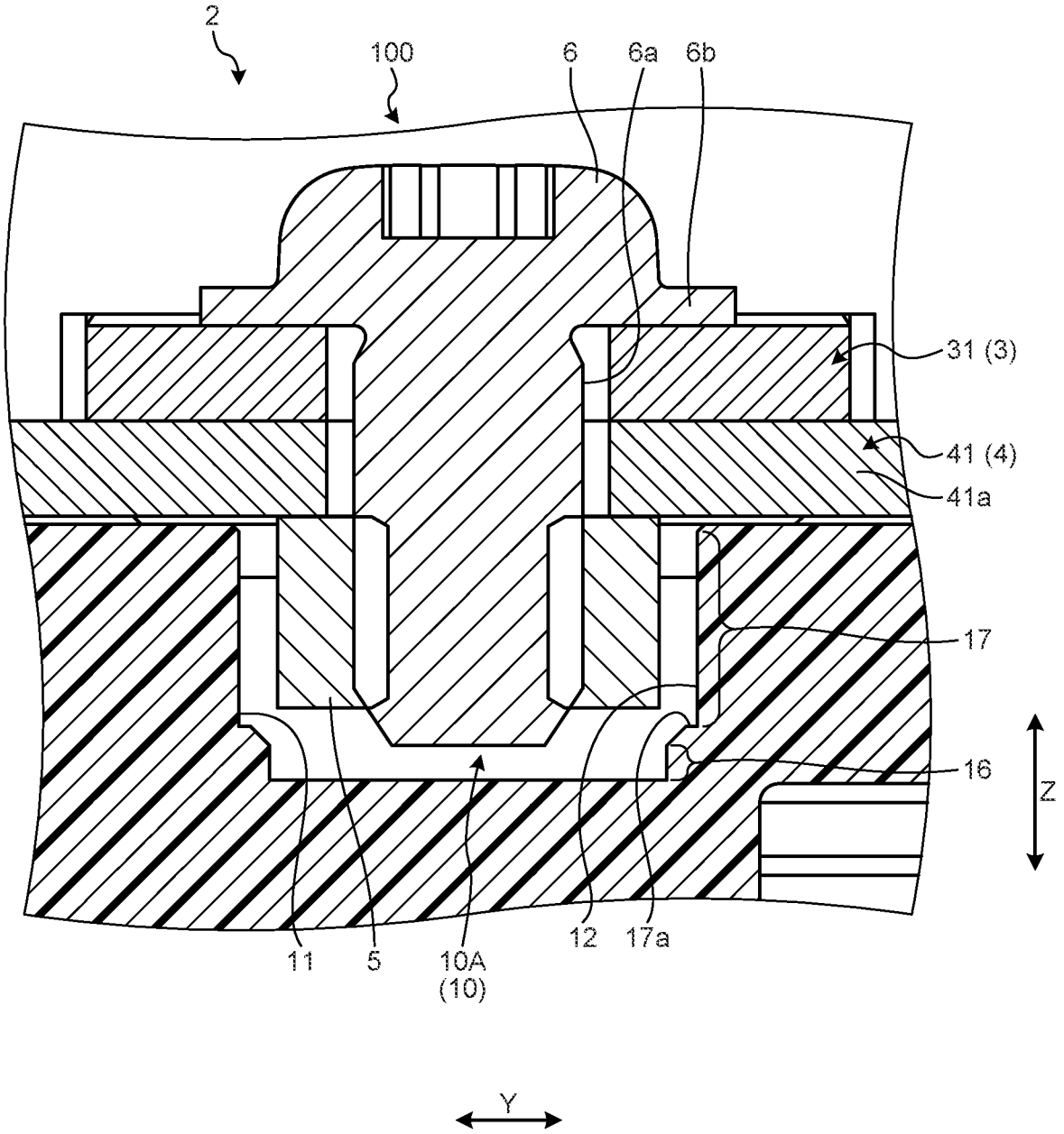
FIG. 17 is a sectional view of the co-fastened first busbar and the terminal portion.
Figure 18:
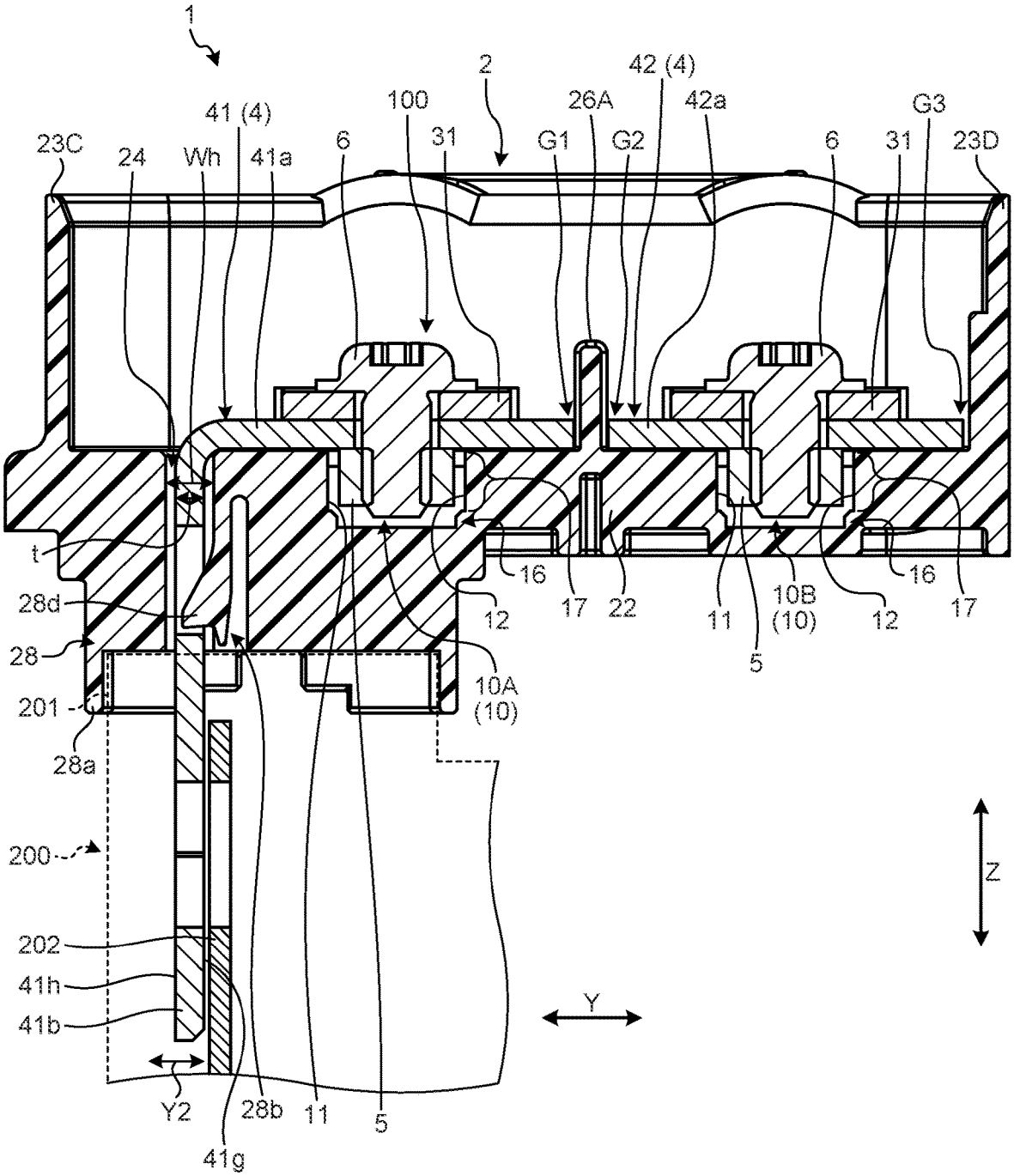
FIG. 18 is a sectional view illustrating the movement of the busbars.
Figure 19:
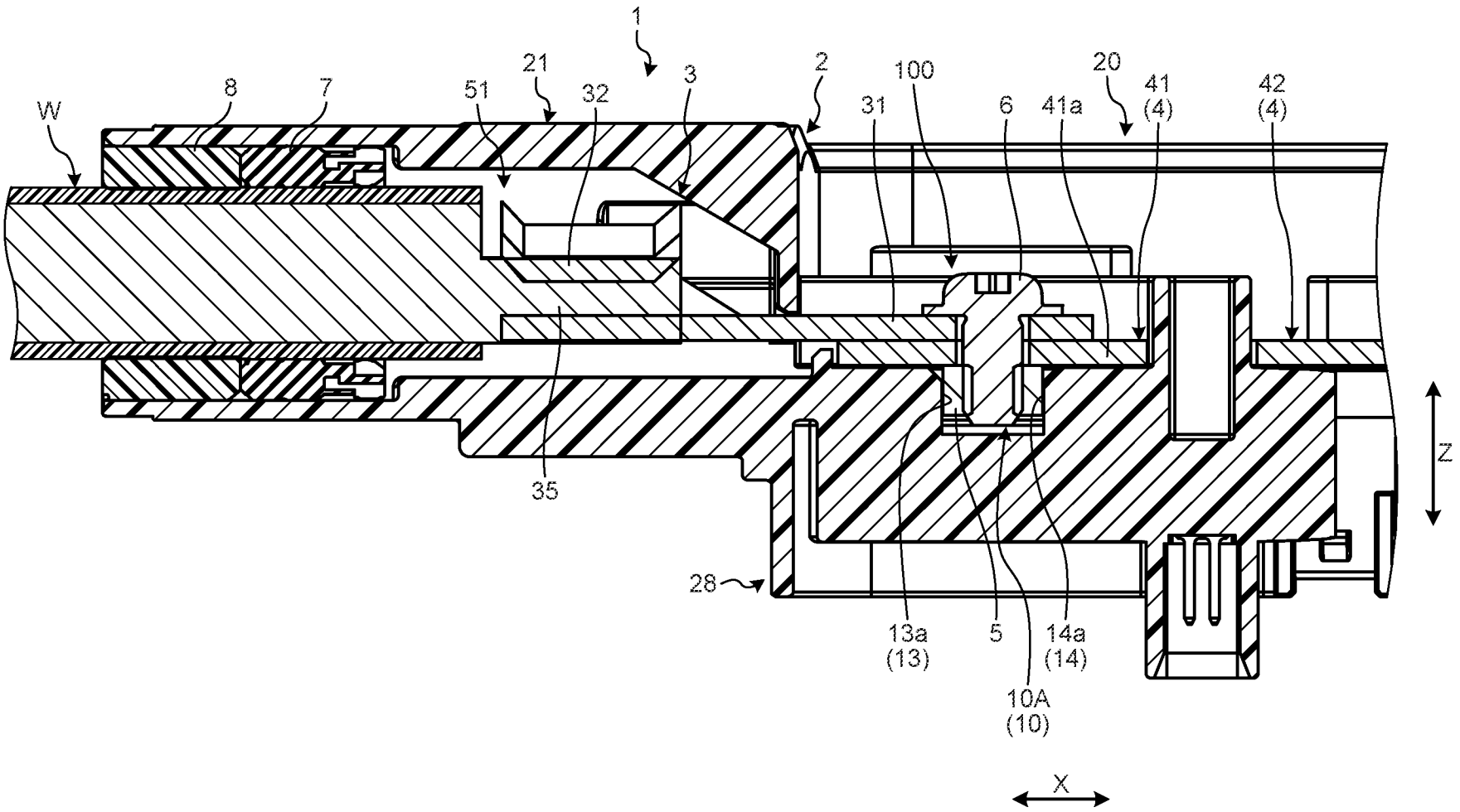
FIG. 19 is a sectional view of the co-fastened first busbar and the terminal portion.

FIG. 11 is a sectional view of a recessed portion according to the embodiment; FIG. 12 is a sectional view of a nut accommodated in the recessed portion; FIG. 13 is a sectional view of the nut accommodated in the recessed portion; FIG. 14 is a sectional view of the bolt being screwed to the nut; FIG. 15 is a sectional view of a bolt being screwed to the nut; FIG. 16 is a sectional view of a co-fastened first busbar and a terminal portion; FIG. 17 is a sectional view of the co-fastened first busbar and the terminal portion; FIG. 18 is a sectional view illustrating the movement of the busbars; and FIG. 19 is a sectional view of the co-fastened first busbar and the terminal portion. FIG. 9 illustrates a IX-IX cross section of FIG. 7. FIGS. 10 and 11 illustrate X-X cross sections of FIG. 7.

As illustrated in FIGS. 1 to 3, a conductor connecting structure 100 according to the present embodiment is provided in a connector 1. The connector 1 is connected to end portions of wires W. As illustrated in FIG. 3 and other drawings, the connector 1 has a housing 2, crimping terminals 3, busbars 4, nuts 5, bolts 6, sealing members 7, and a retainer 8. The conductor connecting structure 100 according to the present embodiment has the housing 2, the crimping terminals 3, the busbars 4, the nuts 5, and the bolts 6.

The connector 1 according to the present embodiment is connected to two wires W. The two wires W are arranged in parallel and extend from the connector 1 in the same direction. In the following description, the axial direction of the wires W is referred to as a "first direction X". The direction in which the wires W are aligned is referred to as a "second direction Y". The second direction Y is orthogonal to the first direction X. The direction orthogonal to both the first direction X and the second direction Y is referred to as a "third direction Z".

The housing 2 is a case body that accommodates the nuts 5, the busbars 4, the crimping terminals 3, the bolts 6, and the sealing members 7. The housing 2 has recessed portions 10 in a shape corresponding to the shape of the nuts 5. The nuts 5 according to the present embodiment are square nuts with a rectangular shape in plan view. The nuts 5 are accommodated in the respective recessed portions 10, as illustrated in FIG. 3.

As illustrated in FIG. 4, the connector 1 has a first busbar 41 and a second busbar 42 as the busbars 4. The first and the second busbars 41 and 42 are plate conductors formed from conductive metal plates. The first busbar 41 has a first terminal portion 41*a* and a second terminal portion 41*b*. The first terminal portion 41*a* is a flat plate terminal portion and is connected to the corresponding crimping terminal 3. The second terminal portion 41*b* is a flat plate terminal portion and is connected, for example, to a terminal of a mating connector. The second busbar 42 has a first terminal portion 42*a* and a second terminal portion 42*b*. The first terminal portion 42*a* is a flat plate terminal portion and is connected to the corresponding crimping terminal 3. The second terminal portion 42*b* is a flat plate terminal portion and is connected, for example, to a terminal of the mating connector.

The first terminal portions 41*a*, 42*a* respectively have through holes 41*c*, 42*c* and notches 41*f*, 42*f*. The through holes 41*c* and 42*c* are holes through which the respective bolts 6 are inserted. Guide ribs 27A, 27B (refer to FIG. 7) of the housing 2 are respectively inserted into the notches 41*f*, 42*f*. The first terminal portions 41*a*, 42*a* are respectively guided along the second direction Y by the guide ribs 27A, 27B and positioned in the first direction X.

The second terminal portions 41*b*, 42*b* respectively have through holes 41*d*, 42*d* and engagement holes 41*e*, 42*e*. The through holes 41*d* and 42*d* are holes through which fastening members such as bolts are inserted. The second terminal portions 41*b* and 42*b* are fixed to the mating terminals, for example, by fastening members. The engagement holes 41*e*, 42*e* engage with locking portions 28*b* (refer to FIG. 10) of the housing 2.

The first busbar 41 is bent so that the first terminal portion 41*a* and the second terminal portion 41*b* are orthogonal to each other. The first busbar 41 and the second busbar 42 are installed in the housing 2 such that the first terminal portions 41*a*, 42*a* overlap with the respective nuts 5. At this time, the second terminal portions 41*b*, 42*b* penetrate through and protrude from the housing 2.

As illustrated in FIG. 5, the crimping terminals 3 are crimped against the wires W. For example, the crimping terminals 3 are formed from metal plates having the electrical conductivity. The crimping terminal 3 has a flat plate terminal portion 31 and a wire connecting portion 32. The shape of the terminal portions 31 is, for example, rectangular. The terminal portions 31 have respective through holes 31*a* through which the bolts 6 are inserted.

The wire connecting portions 32 are tightened against core wires 35 of the wires W and are crimped against the core wires 35. The sealing members 7 are pre-mounted to the covering of the wires W. Furthermore, the retainer 8 is mounted to the wires W. The crimping terminals 3 are inserted into a second housing portion 21 of the housing 2, as illustrated in FIG. 5. The terminal portions 31 of the crimping terminals 3 protrude into a first housing portion 20 of the housing 2 and are put on the first terminal portions 41*a*, 42*a* of the busbars 41, 42. More specifically, one terminal portion 31 overlaps the first terminal portion 41*a* of the first busbar 41, while the other terminal portion 31 overlaps the first terminal portion 42*a* of the second busbar 42.

The bolts 6 are then attached as illustrated in FIG. 6. The bolts 6 are inserted into the through holes 31*a* of the terminal portions 31 and the through holes 41*c*, 42*c* of the busbars 41, 42, and are screwed to the respective nuts 5. The bolts 6 are screwed to the respective nuts 5 to co-fasten the terminal portions 31 and the first terminal portions 41*a*, 42*a* of the busbars 41, 42. In other words, the terminal portions 31 and the first terminal portions 41*a*, 42*a* are physically fixed and electrically connected to each other by the bolts 6 and the nuts 5.

The housing 2 has a fitting portion 28 fitted with the mating connector or a case body of a mating device. The fitting portion 28 is fitted with the mating portion and the second terminal portions 41*b*, 42*b* of the busbars 41, 42 are connected to the mating terminals.

The conductor connecting structure 100 according to the present embodiment is configured to allow relative movement of the busbars 41, 42 with respect to the housing 2, as will be described below. The busbars 41, 42, together with the terminal portions 31, the nuts 5, and the bolts 6, can move along the second direction Y relative to the housing 2. Therefore, the conductor connecting structure 100 according to the present embodiment can absorb tolerances when the busbars 41, 42 are connected to the mating terminals.

As illustrated in FIG. 7 and other drawings, the housing 2 has the first housing portion 20 and the second housing portion 21. The first and the second housing portions 20 and 21 are integrally molded, for example, with an insulating synthetic resin. The first housing portion 20 accommodates the busbars 41, 42, the nuts 5, the bolts 6, and the terminal portions 31 of the crimping terminals 3. The second housing portion 21 is a portion into which the wires W are inserted. The second housing portion 21 accommodates the wire connecting portions 32 of the crimping terminals 3, the sealing members 7, and the end portions of the wires W.

The shape of the first housing portion 20 in plan view is substantially rectangular. The first housing portion 20 has a support wall 22, a first side wall 23A, a second side wall 23B, a third side wall 23C, and a fourth side wall 23D. The support wall 22 is a bottom wall of the first housing portion 20 and supports the busbars 41, 42, and the like. The first side wall 23A, the second side wall 23B, the third side wall 23C, and the fourth side wall 23D are erected from the edges of the support wall 22. The first side wall 23A, the second side wall 23B, the third side wall 23C, and the fourth side wall 23D are connected to each other to form a square cylindrical tube portion 23.

The first side wall 23A and the second side wall 23B are opposite to each other in the first direction X. The third side wall 23C and the fourth side wall 23D are opposite to each other in the second direction Y. The third side wall 23C and the fourth side wall 23D connect the end portions of the first side wall 23A and the end portions of the second side wall 23B along the first direction X.

The support wall 22 has a first through hole 24 and a second through hole 25. The through holes 24, 25 penetrate the support wall 22 along the third direction Z. The sectional shape of the through holes 24 and 25 is a rectangle in which the first direction X is the longitudinal direction. The two through holes 24, 25 are adjacent to the third side wall 23C and aligned along the first direction X. The first through hole 24 is adjacent to the first side wall 23A. The second through hole 25 is adjacent to the second side wall 23B. The second terminal portion 41*b* of the first busbar 41 is inserted into the first through hole 24. The second terminal portion 42*b* of the second busbar 42 is inserted into the second through hole 25.

The support wall 22 has the recessed portions 10. The recessed portions 10 include a first recessed portion 10A and a second recessed portion 10B. The first and the second recessed portions 10A and 10B are adjacent to the first side wall 23A and aligned along the second direction Y. A partition wall 26 is provided between the first recessed portion 10A and the second recessed portion 10B. The partition wall 26 is a wall portion that divides the first busbar 41 from the second busbar 42, and is a rib provided on the support wall 22. The shape of the partition wall 26 in plan view is L-shaped. The partition wall 26 has a first wall portion 26A and a second wall portion 26B. One end of the first wall portion 26A is connected to the first side wall 23A. The first wall portion 26A extends along the first direction X from the first side wall 23A toward the second side wall 23B. The second wall portion 26B is connected to the other end of the first wall portion 26A and extends along the second direction Y toward the third side wall 23C. The end of the second wall portion 26B is located between the first through hole 24 and the second through hole 25.

The first recessed portion 10A is located on the side of the first through hole 24 with respect to the first wall portion 26A. The second recessed portion 10B is located on the side of the fourth side wall 23D with respect to the first wall portion 26A. That is, the first wall portion 26A is located between the first recessed portion 10A and the second recessed portion 10B in the second direction Y. The support wall 22 has a first guide rib 27A and a second guide rib 27B. The first guide rib 27A is a rib that guides the first busbar 41 along the second direction Y. The first guide rib 27A extends along the second direction Y from the first wall portion 26A toward the third side wall 23C. The second guide rib 27B is a rib that guides the second busbar 42 along the second direction Y. The second guide rib 27B extends along the second direction Y from the fourth side wall 23D toward the first wall portion 26A.

As illustrated in FIGS. 8 and 9, the second housing portion 21 protrudes along the first direction X from the first side wall 23A. The second housing portion 21 has a first through hole 51 and a second through hole 52 through which the wires W are inserted. The first through hole 51 and the second through hole 52 penetrate the second housing portion 21 along the first direction X. The sectional shape of the first through hole 51 and the second through hole 52 is circular. The wire W to be connected to the first busbar 41 is inserted into the first through hole 51. The sealing member 7 mounted to this wire W seals between the wall surface of the first through hole 51 and the outer peripheral surface of the wire W. The wire W to be connected to the second busbar 42 is inserted into the second through hole 52. The sealing member 7 mounted to this wire W seals between the wall surface of the second through hole 52 and the outer peripheral surface of the wire W. The second housing portion 21 has projections 53 that engage with the retainer 8. The retainer 8 is fitted with the end portion of the second housing portion 21 to support the seal members 7.

As illustrated in FIGS. 9 and 10, the support wall 22 has a support surface 22*a* and a back surface 22*b*. The support surface 22*a* is a surface that supports the busbars 4 and the terminal portions 31. The tube portion 23 protrudes from the support surface 22*a*. The back surface 22*b* is a surface on a side opposite to the side of the support surface 22*a*. The recessed portions 10 are recessed from the support surface 22*a* toward the back surface 22*b*. The support wall 22 has the fitting portion 28 protruding from the back surface 22*b*. The fitting portion 28 has a cylindrical peripheral wall 28*a*. The sectional shape of the peripheral wall 28*a* is, for example, an oblong shape. The peripheral wall 28*a* is provided with an engagement portion that engages with the mating connector or the case body of the mating device.

The first through hole 24 and the second through hole 25 penetrate the fitting portion 28. Thus, as illustrated in FIG. 2 and other drawings, the first and the second busbars 41 and 42 protrude along the third direction Z from the fitting portion 28. As illustrated in FIG. 7 and FIG. 10, the locking portions 28*b* are provided in the first through hole 24 and the second through hole 25. The locking portions 28*b* each have a flexible arm 28*c* along the third direction Z and a protrusion 28*d* at the tip portion of the arm 28*c*. The protrusions 28*d* engage with the engagement holes 41*e*, 42*e* of the busbars 41, 42 to lock the second terminal portions 41*b*, 42*b*.

As illustrated in FIGS. 9 and 10, the recessed portions 10 each have a first wall surface 11, a second wall surface 12, a third wall surface 13, a fourth wall surface 14, and a bottom surface 15. The first wall surface 11, the second wall surface 12, the third wall surface 13, and the fourth wall surface 14 form a housing space with a rectangular sectional shape. The first and the second wall surfaces 11 and 12 are opposite to each other in an opposing direction. In the housing 2 according to the present embodiment, the opposing direction is the second direction Y. The third and the fourth wall surfaces 13 and 14 connect the first and the second wall surfaces 11 and 12 along the second direction Y. The third and the fourth wall surfaces 13 and 14 are opposite to each other in the first direction X.

As illustrated in FIG. 11, the first and the second wall surfaces 11 and 12 configure a retaining portion 16 and an allowable portion 17. The retaining portion 16 is a portion located at the bottom of the recessed portion 10. The retaining portion 16 is provided, for example, at the innermost side of the recessed portion 10. The allowable portion 17 is a portion located closer to the inlet of the recessed portion 10 than the retaining portion 16 is. The retaining portion 16 retains the corresponding nut 5 before being screwed to the bolt 6. A distance Wd1 between the first wall surface 11 and the second wall surface 12 in the retaining portion 16 is, for example, sized as described below.

FIG. 12 illustrates one nut 5 housed in the corresponding recessed portion 10. The distance Wd1 in the retaining portion 16 is slightly greater than a width Wn of the nut 5. The value of the distance Wd1 in the retaining portion 16 is determined so that the distance Wd1 absorbs tolerances and allows the nut 5 and the bolt 6 to be screwed together. The minimum value of the distance between the first wall surface 11 and the second wall surface 12 is assumed to be Mn1, which is required to align the nut 5 and the bolt 6. In this case, the distance Wd1 in the retaining portion 16 is defined so that the following equation (1) is satisfied.

$$Mn1 \leq Wd1 \quad (1)$$

On the other hand, when the movable range of the nut 5 in the retaining portion 16 is excessive, the position of the nut 5 with respect to the center line CL of the recessed portion 10 will be large, and the bolt 6 may be uninsertable to the nut 5. The maximum value of the distance between the first wall surface 11 and the second wall surface 12 is assumed to be Mx1, which is required so that the bolt 6 will not be uninsertable to the nut 5. In this case, the distance Wd1 in the retaining portion 16 is defined so that the following equation (2) is satisfied.

$$Wd1 \leq Mx1 \quad (2)$$

The value of the distance Wd1 in the retaining portion 16 may be determined so that the nut 5 is substantially non-rotatable. The maximum value of the distance between the first wall surface 11 and the second wall surface 12 is assumed to be Mx2, which is required to make the nut 5 substantially non-rotatable. In this case, the distance Wd1 in the retaining portion 16 may be defined so that both equation (2) above and following equation (3) are satisfied.

$$Wd1 \leq Mx2 \quad (3)$$

A distance Wd2 between the first wall surface 11 and the second wall surface 12 in the allowable portion 17 is greater than the distance Wd1 in the retaining portion 16. The allowable portion 17 is configured to allow movement of the nut 5 along the second direction Y in the state of completion of screwing the nut 5 to the bolt 6, as described below. On the first wall surface 11, the portion configuring the retaining portion 16 is closer to the center line CL than the portion configuring the allowable portion 17. Furthermore, on the second wall surface 12, the portion configuring the retaining portion 16 is closer to the center line CL than the portion configuring the allowable portion 17. Thus, in a state where the nut 5 is retained by the retaining portion 16, the first wall surface 11 of the allowable portion 17 and the second wall surface 12 of the allowable portion 17 are separated from the nut 5. An introducing tapered shape and a step are provided between the retaining portion 16 and the allowable portion 17.

FIG. 13 illustrates the nut 5 accommodated in the recessed portion 10. The third wall surface 13 has a restricting surface 13*a* and a tapered surface 13*b*. The fourth wall surface 14 has a restricting surface 14*a* and a tapered surface 14*b*. The restricting surfaces 13*a*, 14*a* extend along the third direction Z from the bottom surface 15 to the vicinity of the inlet of the recessed portion 10. For example, the restricting surfaces 13*a*, 14*a* may be substantially parallel. A distance Wd3 between the restricting surface 13*a* and the restricting surface 14*a* is slightly greater than the width Wn of the nut 5.

For example, the value of the distance Wd3 is determined to make the nut 5 substantially non-rotatable. The maximum value of the distance between the restricting surface 13*a* and the restricting surface 14*a* is assumed to be Mx3, which is required to make the nut 5 substantially non-rotatable. In this case, the distance Wd3 is defined so that the following equation (4) is satisfied.

$$Wd3 \leq Mx3 \quad (4)$$

The distance Wd3 may be defined so that the distance Wd3 absorbs tolerances and allows the nut 5 and the bolt 6 to be screwed together. The minimum value of the distance between the restricting surface 13*a* and the restricting surface 14*a* is assumed to be Mn2, which is required to align the nut 5 and the bolt 6. In this case, the distance Wd3 is defined so that the following equation (5) is satisfied.

$$Mn2 \leq Wd3 \quad (5)$$

It is desirable that the distance Wd3 is defined within a range in which the bolt 6 will not be uninsertable to the nut 5. The maximum value of the distance between the restricting surface 13*a* and the restricting surface 14*a* is assumed to be Mx4, which is required so that the bolt 6 will not be uninsertable to the nut 5. In this case, the distance Wd3 is defined so that the following equation (6) is satisfied. The value of the distance Wd3 may be smaller than the value of the distance Wd1 in the retaining portion 16. However, the value of the distance Wd3 is not limited to this, and may be the same or substantially the same as the value of the distance Wd1 in the retaining portion 16.

$$Wd3 \leq Mx4 \quad (6)$$

The tapered surfaces 13*b*, 14*b* are inclined with respect to the first direction X and the third direction Z, respectively. The tapered surfaces 13*b*, 14*b* are inclined so that the distance between the tapered surfaces 13*b* and 14*b* becomes greater toward the inlet of the recessed portion 10. The tapered surfaces 13*b*, 14*b* introduce the nut 5 between the restricting surfaces 13*a*, 14*a*.

FIG. 14 illustrates the bolt 6 beginning to be screwed to the nut 5. When the bolt 6 is rotated in a state where a male screw portion 6*a* of the bolt 6 is engaged with a female screw portion 5*a* of the nut 5, the nut 5 moves toward the inlet of the recessed portion 10 as illustrated by arrows Y1. At this time, the restricting surfaces 13*a* and 14*a* lock the nut 5 and restrict the rotation of the nut 5. There is a gap between the restricting surfaces 13*a*, 14*a* and the nut 5, which allows movement of the nut 5 along the third direction Z. In other words, the restricting surfaces 13*a*, 14*a* are configured to allow the nut 5 to move along the third direction Z while restricting the rotation of the nut 5.

In a state where the rotation of the nut 5 is restricted, the bolt 6 is further rotated relative to the nut 5, so that the nut 5 is pulled out from the retaining portion 16, as illustrated in FIG. 15. The nut 5 illustrated in FIG. 15 is moved to a position closer to the inlet of the recessed portion 10 in the third direction Z with respect to the retaining portion 16. When the bolt 6 is further rotated, the terminal portion 31 and the busbar 4 are co-fastened, and finally fastened to each other.

FIGS. 16 and 17 illustrate sectional views of the first busbar 41 in a state in which the co-fastening is completed. The terminal portion 31 and the first terminal portion 41*a* of the first busbar 41 are sandwiched between a head portion 6*b* of the bolt 6 and the nut 5. The bolt 6 and nut 5 co-fasten the terminal portion 31 and the first terminal portion 41*a*, so as to electrically connect the terminal portion 31 and the first terminal portion 41*a*. As illustrated in FIG. 16, with co-fastening completed, the restricting surfaces 13*a*, 14*a* are opposite to the nut 5. In other words, the restricting surfaces 13*a*, 14*a* are formed to be able to restrict the rotation of the nut 5 continuously until the co-fastening is completed.

As illustrated in FIG. 17, with the co-fastening completed, the nut 5 is located closer to the inlet of the first recessed portion 10A with respect to the retaining portion 16. In other words, the nut 5 exits from the retaining portion 16 and is opposite to the allowable portion 17 of the first wall surface 11 and the second wall surface 12. The allowable portion 17 allows the nut 5 to move along the second direction Y.

The housing 2 according to the present embodiment is configured to allow movement of the busbars 4 along the second direction Y. For example, as illustrated in FIG. 18, a gap G1 is provided between the first wall portion 26A of the partition wall 26 and the first terminal portion 41*a* of the first busbar 41. A gap G2 is provided between the first wall portion 26A and the first terminal portion 42*a* of the second busbar 42. A gap G3 is provided between the fourth side wall 23D and the first terminal portion 42*a* of the second busbar 42. Thus, the housing 2 allows the first terminal portions 41*a*, 42*a* to move along the second direction Y.

The width of the first through hole 24 and the second through hole 25 is large enough to allow the second terminal portions 41*b* and 42*b* to move along the second direction Y. For example, as illustrated in FIG. 18, a width Wh of the first through hole 24 is greater than a plate thickness t of the second terminal portion 41*b*. Thus, the first through hole 24 allows the second terminal portion 41*b* to move along the second direction Y. Similarly, the second through hole 25 allows the second terminal portion 42*b* of the second busbar 42 to move along the second direction Y.

FIG. 18 illustrates a fitting portion 201 of a mating connector 200. The fitting portion 201 of the mating connector 200 is fitted with the fitting portion 28 of the housing 2. The mating connector 200 has a terminal 202 corresponding to the second terminal portion 41*b* of the first busbar 41. The second terminal portion 41*b* has main surfaces 41*g* and 41*h*. The main surfaces 41*g* and 41*h* are contact surfaces to be in electrical contact with the mating terminal 202. In FIG. 18, the main surface 41*g* is opposite to the terminal 202 and abuts on the terminal 202. The second terminal portion 41*b* can move in the second direction Y relative to the mating terminal 202, as indicated by arrow Y2. Therefore, the conductor connecting structure 100 according to the present embodiment allows the second terminal portion 41*b* to be connected to the mating terminal 202 by absorbing the tolerances in the second direction Y. For example, this makes it easier to absorb tolerances and bring the main surface 41*g* into contact with the mating terminal 202.

The conductor connecting structure 100 according to the present embodiment also allows the second busbar 42 to move in the second direction Y. As illustrated in FIG. 18, the terminal portion 31 and the first terminal portion 42*a* of the second busbar 42 are co-fastened by the bolt 6 and the nut 5. In a state in which the co-fastening is completed, the nut 5 is located closer to the inlet of the second recessed portion 10B with respect to the retaining portion 16. The nut 5 has exited from the retaining portion 16 and is opposite to the allowable portion 17 of the second recessed portion 10B. The distance between the first wall surface 11 and the second wall surface 12 in the allowable portion 17 is determined to allow movement of the nut 5 along the second direction Y. Accordingly, the conductor connecting structure 100 according to the present embodiment can absorb the tolerances in the second direction Y and connect the second terminal portion 42*b* of the second busbar 42 to the terminal of the mating connector 200.

In the conductor connecting structure 100 according to the present embodiment, the direction in which the movement of the nuts 5 is allowed is a direction that is unlikely to affect the sealing performance by the sealing members 7. As illustrated in FIG. 19, the sealing member 7 according to the present embodiment is a shaft seal that seals between the outer peripheral surface of the wire W and the inner peripheral surface of the second housing portion 21. The restricting surfaces 13*a*, 14*a* of the recessed portion 10 restrict the movement of the nut 5 along the first direction X. Therefore, the conductor connecting structure 100 according to the present embodiment can suppress the rattling of the nut 5 and the busbar 4 in the first direction X.

As explained above, the conductor connecting structure 100 according to the embodiment includes the crimping terminals 3, the busbars 4, the housing 2, the nuts 5, and the bolts 6. The crimping terminals 3 are first conductors having the flat plate terminal portions 31. The busbars 4 are second conductors having the flat plate first terminal portions 41*a*, 42*a*. The housing 2 is a support having the recessed portions 10. The nuts 5 are first screw members housed in the recessed portions 10. The bolts 6 are second screw members that co-fasten the terminal portions 31 and the first terminal portions 41*a*, 42*a* by screwing to the nuts 5.

The recessed portion 10 have the first wall surface 11 and the second wall surface 12, which are opposite to each other in the second direction Y, and the restricting surfaces 13*a*, 14*a*. The restricting surfaces 13*a* and 14*a* connect the first wall surface 11 and the second wall surface 12 along the second direction Y, and are the surfaces that restrict the rotation of the nut 5. The first wall surface 11 and the second wall surface 12 configure the retaining portion 16 and the allowable portion 17. The retaining portion 16 is located at the bottom of the recessed portion 10 and retains the nut 5 before being screwed to the bolt 6. The allowable portion 17 is located closer to the inlet of the recessed portion 10 than the retaining portion 16. The distance Wd2 between the first wall surface 11 and the second wall surface 12 in the allowable portion 17 is greater than the distance Wd1 between the first wall surface 11 and the second wall surface 12 in the retaining portion 16. The conductor connecting structure 100 according to the present embodiment can allow movement of the nut 5 along the second direction Y, which is the opposing direction. In other words, the conductor connecting structure 100 according to the present embodiment allows position adjustment of the busbar 4 in a direction intersecting the fastening direction by the nuts 5 and the bolts 6.

According to the present embodiment, the first screw member is the nut 5 and the second screw member is the bolt 6. The bolt 6 is screwed to the nut 5 and rotated relative to the nut 5, thereby pulling the nut 5 out of the retaining portion 16. In other words, the nut 5 is retained by the retaining portion 16 when the screwing begins and is pulled out from the retaining portion 16 by the time the co-fastening is complete. The nut 5 pulled out from the retaining portion 16 is located in the space corresponding to the allowable portion 17 and is allowed to move along the second direction Y.

The recessed portion 10 according to the present embodiment has the third wall surface 13 and the fourth wall surface 14 that face each other and connect the first wall surface 11 and the second wall surface 12 along the second direction Y. Each of the third and the fourth wall surfaces 13 and 14 restricts rotation of the nut 5 as the restricting surfaces 13*a* and 14*a*. The rotation of the nut 5 is restricted by the third and the fourth wall surfaces 13 and 14, so that the screwing of the bolt 6 to the nut 5 is properly performed.

The support according to the present embodiment is the housing 2 of the connector 1. The second conductors are the busbars 4 having the first terminal portions 41*a*, 42*a* connected to the crimping terminals 3 and the second terminal portions 41*b*, 42*b* connected to the mating terminal 202. The busbars 4 are bent so that the first terminal portions 41*a*, 42*a* and the second terminal portions 41*b*, 42*b* are orthogonal to each other. The second direction Y, which is the opposing direction, is orthogonal to the main surfaces 41*g*, 41*h* of the second terminal portions 41*b*, 42*b*. This facilitates the absorption of tolerances in the connection of the mating terminal 202 to the second terminal portions 41*b*, 42*b*.

The housing 2 according to the present embodiment has the guide ribs 27A, 27B guiding the first terminal portions 41*a*, 42*a* along the second direction Y, which is the opposing direction. Therefore, the movement of the first terminal portions 41*a*, 42*a* along the second direction Y is smoothly performed.

The first conductors according to the present embodiment are the crimping terminals 3 connected to the wires W. The support is the housing 2 of the connector 1. A portion between the outer peripheral surface of the wires W and the housing 2 is sealed by the sealing members 7. The opposing direction is the second direction Y, which is orthogonal to the axial direction of the wires W. Therefore, the busbars 4 can be allowed to move without affecting the sealing performance of the seal members 7.

Modifications of the Embodiment

The first screw members accommodated in the recessed portions 10 may be the bolts 6. In this case, the head portions 6*b* of the bolts 6 are housed in the recessed portions 10. The male screw portions 6*a* partially protrude from the recessed portions 10, and are inserted into the through holes 41*c*, 42*c* of the first terminal portions 41*a*, 42*a* and the through holes 31*a* of the terminal portions 31. The nuts 5 are screwed to the male screw portions 6*a* and pull out the head portions 6*b* from the retaining portions 16 by rotation.

The shape of the nuts 5 accommodated in the recessed portions 10 and the shape of the head portions 6*b* of the bolts 6 accommodated in the recessed portions 10 are not limited to a rectangle. Instead of the rectangle, a polygon such as a hexagon may be adopted. The number of busbars 4 that the connector 1 has is not limited to two. The first conductors are not limited to the crimping terminals 3 connected to the wires W. The conductor connecting structure 100 may connect the busbars to each other. The conductor connecting structure 100 may co-fasten three or more terminal portions.

The fitting object of the connector 1 may be a fitting portion in the case body of the mating device. The object to which the conductor connecting structure 100 is applied is not limited to the connector 1. For example, the conductor connecting structure 100 can be applied to a terminal block. The conductor connecting structure 100 can be applied to various locations where a plurality of conductors are co-fastened by screw members.

The contents disclosed in the above-described embodiments and modifications can be combined as appropriate.

In a conductor connecting structure according to the embodiment, first and second wall surfaces of each recessed portion configure a retaining portion located at the bottom of the recessed portion and retaining a first screw member before being screwed to a second screw member, and an allowable portion located closer to the inlet of the recessed portion than the retaining portion. The distance between the first and the second wall surfaces in the allowable portion is greater than the distance between the first and the second wall surfaces in the retaining portion. The conductor connecting structure according to the embodiment provides the effect of enabling positional adjustment of conductors in a direction that intersects a fastening direction by the screw members.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A conductor connecting structure comprising:

a first conductor having a flat plate terminal portion;

a second conductor having a flat plate terminal portion;

a support having a recessed portion;

a first screw member accommodated in the recessed portion; and a second screw member that co-fastens the terminal portion of the first conductor and the terminal portion of the second conductor by screwing to the first screw member, wherein the recessed portion has a first wall surface and a second wall surface that face each other in an opposing direction, and a restricting surface that connects the first wall surface and the second wall surface along the opposing direction and restricts rotation of the first screw member, the first wall surface and the second wall surface configure a retaining portion, located at a bottom of the recessed portion, configured to retain the first screw member before being screwed to the second screw member, and an allowable portion located closer to an inlet of the recessed portion than the retaining portion, a distance between the first wall surface and the second wall surface in the allowable portion is greater than a distance between the first wall surface and the second wall surface in the retaining portion, and the first screw member is pulled from the retaining portion at the bottom of the recessed portion to the allowable portion that is spaced away from the bottom of the recessed portion as the second screw member is screwed onto the first screw member.

2. The conductor connecting structure according to claim 1, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

3. The conductor connecting structure according to claim 1, wherein the support is a housing of a connector, the second conductor is a busbar that has a first terminal portion connected to the first conductor and a second terminal portion to be connected to a mating terminal, and is bent so that the first terminal portion and the second terminal portion are orthogonal to each other, and the opposing direction is a direction orthogonal to a main surface of the second terminal portion.

4. The conductor connecting structure according to claim 3, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

5. The conductor connecting structure according to claim 3, wherein the housing has a rib configured to guide the first terminal portion along the opposing direction.

6. The conductor connecting structure according to claim 5, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

7. The conductor connecting structure according to claim 1, wherein the recessed portion has a third wall surface and a fourth wall surface that face each other and connect the first wall surface and the second wall surface along the opposing direction respectively, and each of the third and the fourth wall surfaces restricts the rotation of the first screw member as the restricting surface.

8. The conductor connecting structure according to claim 7, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

9. The conductor connecting structure according to claim 7, wherein the support is a housing of a connector, the second conductor is a busbar that has a first terminal portion connected to the first conductor and a second terminal portion to be connected to a mating terminal, and is bent so that the first terminal portion and the second terminal portion are orthogonal to each other, and the opposing direction is a direction orthogonal to a main surface of the second terminal portion.

10. The conductor connecting structure according to claim 9, wherein the housing has a rib configured to guide the first terminal portion along the opposing direction.

11. The conductor connecting structure according to claim 9, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

12. The conductor connecting structure according to claim 1, wherein the first screw member is a nut, the second screw member is a bolt, and the bolt is screwed to the nut and rotated relative to the nut to pull the nut out of the retaining portion.

13. The conductor connecting structure according to claim 12, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

14. The conductor connecting structure according to claim 12, wherein the support is a housing of a connector, the second conductor is a busbar that has a first terminal portion connected to the first conductor and a second terminal portion to be connected to a mating terminal, and is bent so that the first terminal portion and the second terminal portion are orthogonal to each other, and the opposing direction is a direction orthogonal to a main surface of the second terminal portion.

15. The conductor connecting structure according to claim 14, wherein the housing has a rib configured to guide the first terminal portion along the opposing direction.

16. The conductor connecting structure according to claim 14, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

17. The conductor connecting structure according to claim 12, wherein the recessed portion has a third wall surface and a fourth wall surface that face each other and connect the first wall surface and the second wall surface along the opposing direction respectively, and each of the third and the fourth wall surfaces restricts the rotation of the first screw member as the restricting surface.

18. The conductor connecting structure according to claim 17, wherein the first conductor is a terminal connected to a wire, the support is a housing of a connector, a portion between an outer peripheral surface of the wire and the housing is sealed by a sealing member, and the opposing direction is a direction orthogonal to an axial direction of the wire.

19. The conductor connecting structure according to claim 17, wherein the support is a housing of a connector, the second conductor is a busbar that has a first terminal portion connected to the first conductor and a second terminal portion to be connected to a mating terminal, and is bent so that the first terminal portion and the second terminal portion are orthogonal to each other, and the opposing direction is a direction orthogonal to a main surface of the second terminal portion.

20. The conductor connecting structure according to claim 19, wherein the housing has a rib configured to guide the first terminal portion along the opposing direction.

* * * * *